US005181860A

United States Patent [19]

Honma et al.

[11] Patent Number: 5,181,860

[45] Date of Patent: Jan. 26, 1993

[54] ELECTRICAL CONNECTOR WITH ROTATABLE LOCKING RING

[75] Inventors: Kazuhiro Honma; Kunio Watanabe; Takeshi Morita; Shingo Nanao, all of Tokyo, Japan

[73] Assignees: Daiichi Denshi Kogyo Kabushiki Kaisha; Japan Aviation Electronics Industry Limited, Japan

[21] Appl. No.: 675,253

[22] Filed: Mar. 26, 1991

[30] Foreign Application Priority Data

Mar. 28, 1990 [JP] Japan ..... 2-79753
Jun. 18, 1990 [JP] Japan ..... 2-63556[U]
Jun. 18, 1990 [JP] Japan ..... 2-63557[U]

[51] Int. Cl.[5] ..... H01R 13/623

[52] U.S. Cl. ..... 439/321; 285/82; 439/95; 439/318; 439/599; 439/748

[58] Field of Search ..... 439/312, 313, 315, 318–323, 439/595, 744, 746, 747, 748, 95, 752, 598, 599; 285/81, 82, 88, 85

[56] References Cited

U.S. PATENT DOCUMENTS 2,984,811 5/1961 Hennessey, Jr. et al. .
3,552,777 1/1971 Heinrich et al. ..... 285/81
3,786,396 1/1974 Kemmer et al. ..... 439/321
4,741,706 5/1988 Takeda et al. ..... 439/321
5,002,504 3/1991 Carlson ..... 439/595

FOREIGN PATENT DOCUMENTS 0237423 9/1987 European Pat. Off. .
1168745 12/1958 France .
2053590 2/1981 United Kingdom .

*Primary Examiner*—Neil Abrams
*Attorney, Agent, or Firm*—Silverman, Cass & Singer, Ltd.

[57] ABSTRACT

An electrical connector includes a plug connector having a plug shell formed with a flange and a receptacle connector having a receptacle shell provided on its outer circumference with a fitting device. The electrical connector further includes a coupling ring surrounding the plug shell and rotatable and holding the flange of the plug shell. The coupling ring has on its inner circumference a fitting device fitted with the first mentioned fitting device and a flange urging portion for urging the flange, and a key provided between the receptacle shell and the plug shell for preventing relative rotation therebetween. The electrical connector includes at least one wave-shaped annular spring interposed between the flange and the flange urging portion and rotatable together with the coupling ring. The wave-shaped annular ring and the flange are formed in their opposed surfaces with at least one protrusion and at least one recess, respectively, which are detachably fitted with each other, thereby forming a click lock device for causing the protrusion to fall into the recesses to produce click sound when the plug connector and the receptacle connector have been fitted.

In an alternate embodiment, the electrical connector has some contacts connected to earth circuits which comprise earth lugs.

2 Claims, 25 Drawing Sheets

ELECTRICAL CONNECTOR WITH ROTATABLE LOCKING RING

BACKGROUND OF THE INVENTION

This invention relates to an electrical connector to be mounted mainly on a main body, control box or the like of a machine tool, servomotor, robot or the like.

FIGS. 1*a* and 1*b* illustrate a circular connector as one example of hitherto used electrical connectors in a sectional view and a side view seen from the fitting side (on the right side of FIG. 1*a*) of the connector, respectively.

Referring to FIG. 1*a*, a plug shell 11 is cylindrical and provided on its outer circumferential surface with a key 111 extending in a longitudinal direction on the fitting side. The outer circumferential surface of the plug shell 11 provided with the key 111 is adapted to be fitted in an inner bore of the receptacle shell of a receptacle connector (not shown) mating with this plug shell 11.

An insert block 142 having contacts 141 held and fixed thereto is mounted in and fixed to an inner bore 112 of the plug shell 11 by means of an annular anchoring spring 143. FIG. 1*a* illustrates only two contacts 141 on the sectional plane of the drawing and other contacts are not shown.

These contacts 141 are adapted to contact mating contacts (usually socket contacts) provided in the receptacle connector (not shown) to establish an electric connection.

Moreover, the plug shell 11 is provided on the outer circumferential surface with a flange 113.

A coupling ring 12 cylindrical in shape surrounds the plug shell 11 and is provided on the fitting side (on the right side of the drawing, FIG. 1*a*) with fitting means 121 (a single thread screw in this embodiment). This fitting means 121 is adapted to fit with fitting means provided on the receptacle shell of the receptacle connector (not shown).

The coupling ring 12 is formed with a circumferential groove 122 in which a retainer ring 13 as a C-shaped washer is fitted. The retainer ring 13 is fixed snugly in the circumferential groove 122 so that the retainer ring 13 does not wobble with any external disturbance. When the coupling ring 12 is fitted in the mating receptacle connector and is being moved toward the receptacle connector, the retainer ring 13 abuts against the rear end of the flange 113 (on the left side of the flange 113 in the drawing) to transmit urging force (thrust) to the flange 113 as a flange urging portion.

The flange 113 is accommodated between the retainer ring 13 and a shoulder 123 formed in the coupling ring 12 with some play or clearance. Therefore, the coupling ring 12 is rotatable relative to the plug shell 11 to facilitate the insertion of the plug shell 11 into the mating receptacle connector and the engagement of the fitting means 121 with the fitting means of the receptacle connector. With the coupling ring 12 rotatable when free from the mating receptacle connector in this manner, the threaded engagement of the fitting means can be started by manually rotating the coupling ring 12 relying upon the manual touch an operator in order to connect the plug and receptacle connectors. Consequently, this arrangement is one advantage for the connectors which are frequently arranged in narrow spaces between appliances.

A back shell 15 is a cylindrical cover for protecting connections (on the left ends of the contacts in FIG. 1*a*) of electric wires (not shown) connected to the contacts 141. The back shell 15 is integrally fixed to the plug shell 11 with the aid of pipe threads formed on the outer circumference of the rear end (on the left end) of the plug shell 11.

In the prior art, a single thread screw having a relatively small pitch has often been used as the fitting means 121 because it is preferable for connectors requiring large thrust. In more detail, there is a relation $f \propto T/P$ where f is thrust, T is torque to be applied to the coupling ring 12 and P is a pitch of screw. On the other hand, the torque T can be manually set at substantially constant valued from 15 kg-cm to 20 kg-cm. Therefore, the smaller the pitch P of screw, the larger is the thrust to be obtained.

In connectors, however, a certain length of fitting between the connectors is needed so that the plug shell must be moved forward at least through the fitting length for proper fitting of the connectors. Accordingly, if the pitch of screw is small, the number of rotations of the coupling ring becomes large so that operation of the coupling becomes difficult.

In electrical connectors, moreover, there are many cases where the required thrust is not very large depending upon number, configuration and construction of contacts. In such cases, it may be desirable to provide screws having large pitches.

If the pitch of a screw is large, the rotating number of a coupling ring becomes advantageously less. However, the screws with large pitches are likely to unscrew due to vibration and the like. Therefore, they encounter a new difficulty of increased chance of disconnection of connectors mating.

In connectors, furthermore, it is sufficient to advance a plug shell through a predetermined distance (more than a fitting length) as a design value of the connector and fix it thereat, whereas the completion of the advance of the plug shell through the predetermined distance with the aid of screw can be detected only by change in torque applied to the coupling ring. Therefore, it is not an easy matter to detect whether the coupling ring has been advanced to the fullest extent.

FIG. 2 illustrates another example of hitherto used electrical connectors. This connector includes a receptacle connector 1B' having a pin contact a secured to an insulator b, and a plug connector 1A' having a socket contact c provided in an insert aperture e of a base insulator d. In this case, the receptacle connector 1B' is directly connected to the plug connector 1A'.

The plug connector 1A' is called a front release connector, whose socket contact c can be disconnected from the pin contact a of the receptacle connector 1B' by operation on the fitting side with the receptacle 1B'.

This disconnection will be explained referring to FIG. 2. A cylindrical removing jig (not shown) is inserted through the fitting portion of the receptacle connector 1B' into a clearance between the inner wall of the insert aperture e and the socket contact c so that an anchoring tongue f of the socket contact c is deformed inwardly to disengage from an anchoring step g formed on the inner wall of the insert aperture e. Under this condition, therefore, by pulling a cable h connected to the socket contact c rearward, the socket contact c is removed from the insert aperture e.

With the plug connector 1A' of the front release connector, however, an opening of the insert aperture e on the fitting side is formed in a relatively large size for inserting the removing jig thereinto. If the receptacle connector 1B' is fitted in an inclined position with the plug connector 1A', the pin contact a of the receptacle connector 1B' abuts against a tip of the socket contact c to damage it or penetrates into a space between the socket contact c and the inner wall of the insert aperture e. These phenomena detrimentally affect the reliable connection between the receptacle connector 1B' and the plug connector 1A'. This results from the fact that the difference between the inner diameter of the insert aperture e and the outer diameter of the socket contact c is more than twice the thickness of the cylindrical portion of the jig.

In order to form an earth circuit for a hitherto used plug connector mounted on a main body of a machine or a control box, one end of a ground connection lead wire is connected together with a protection circuit lead wire to a ground protection circuit terminal provided on the plug connector separately from a signal terminal, and the other end of the ground connection lead wire is connected to the control box or the like by means of connector set screws.

In such a prior art, in order to form the earth circuit, the ground connection lead wire is particularly prepared and its end must be clamped to the control box together with a connector. This construction is complicated and difficult to operate. Moreover, as the earth circuit is provided only on the side of a receptacle connector, there is a risk of electric current inadvertently flowing through a worker or so-called electric shock occurring when he connects external contacts to the receptacle connector, while holding the plug connector. Therefore, this arrangement includes a problem concerning protection of human beings.

SUMMARY OF THE INVENTION

It is a primary object of the invention to provide an electrical connector composed of a plug connector and a receptacle connector and including fitting means, for example, screw means relatively rotatable and located between the plug and receptacle connectors, and having a mechanism for preventing the fitting means from loosening even when using screw means of a large pitch and enabling an operator to know completion of fitting of the plug and receptacle connectors.

In order to accomplish this object, the invention provides an electrical connector comprising a plug connector and a receptacle connector for receiving the plug connector fitted therewith, said receptacle connector including a cylindrical receptacle shell provided on its outer circumference with fitting means extending circumferentially about a fitting axis, said plug connector including a cylindrical plug shell having a portion to be inserted into an inner aperture of said receptacle shell and a flange provided on an outer circumference of the plug shell, a cylindrical coupling ring surrounding the outer circumference of the plug shell and rotatable and holding said flange of the plug shell on its forward and rearward sides, said coupling ring having on its inner circumference fitting means adapted to be fitted with said fitting means provided on the receptacle shell and a flange urging portion for urging said flange on the side opposite to said portion of the plug shell to be inserted with respect to the flange, key means provided between the inner bore of said receptacle shell and the portion of the plug shell to be inserted into the inner aperture of said receptacle shell for preventing relative rotation between the plug and receptacle shells, at least one wave-shaped annular spring interposed between the flange and the flange urging portion, said wave-shaped annular spring being rotatable together with the coupling ring, and said wave-shaped annular spring and the flange being formed in their opposed surfaces with at least one protrusion and at least one recess, respectively, to form click lock means, the protrusion and the recess being oriented to be coincident in position with each other and detachably fitted with each other when said plug connector and said receptacle connector have been fitted.

In the above arrangement, the term "cylindrical" may be any configuration, so long as they have the constitutions and functions above described.

The "fitting means" used herein is intended to include screw threads, bayonet joint, and intermediate means between these means. For example, spiral anchoring steps (**262*d*) in FIG. 9 and protrusions (272*d*) in FIG. 10** may also be used.

The wave-shaped annular spring is generally preferably annular. The wave-shaped annular spring is arranged in the inner bore of the cylindrical coupling ring, and the rear portion of the plug shell extends through the center hole of the wave-shaped annular spring. This spring has wave portions along its circumference and whose amplitudes are in the axial direction of the ring. The larger the amplitude, the smaller is the force required to compress the spring. However, as the spring serves to transmit the thrust by abutting against the flange, it is preferable that the number of wave portions is at least two equally spaced. In many cases, the protrusions are provided on the tops of the wave portions which first abut against the flange. However, the protrusions may be provided at any portions which abut against the flange by the completion of the fitting of the connectors. In FIG. **5*a***, the protrusion is positioned slightly shifted from the top of the wave portion.

These protrusions are detachably fitted in the recesses of the flange. In other words, after fitting, when the coupling ring is again subjected to torque, the protrusions can be removed from the recesses. In this case, the shapes and sizes of the protrusions and recesses and the urging force (compressive force) of the wave-shaped annular spring will determine the force for dislodging the protrusions from the recesses and the loudness and sharpness of the click sound.

Moreover, the wave-shaped annular spring is not necessarily completely annular, but may be, for example, polygonal as hexagonal, octagonal or the like or C-shaped which is formed by removing a part from a circle.

It is another object of the invention to provide a front release connector whose contacts are connected with a great reliability without wobbling of tip ends of the contacts during connecting operation.

For this object, the electrical connector includes a base insulator having at least one contact insert aperture and a contact inserted and anchored at the contact insert aperture, said contact being removed from the contact insert aperture of the base insulator on a connector fitting side, said electrical connector includes a cover insulator detachably secured to the base insulator on the connector fitting side and having a through-hole communicating with said contact insert aperture of the base insulator and having a diameter smaller than than that of the contact insert aperture, thereby enabling said through-hole to guide insertion of the contact.

With this arrangement, when the connector is connected to a mating connector, contacts of the mating connector are inserted through the through-apertures of the cover insulator into the piercing apertures of the base insulator. Therefore, the contacts of the mating connector are reliably introduced with their tip ends guided to contacted positions by the through-apertures of the cover insulator.

Moreover, when the cover insulator has been removed from the base insulator, a relatively large bore opens through which the contacts can be released through this bore on the fitting side of the connectors.

It is a further object of the invention to provide an electrical connector having some contacts to be connected to earth circuits, which comprises earth lugs to make easy the connection of the contacts to the earth circuits without connecting any particular lead wires.

In order to achieve this object, in a connector including a cylindrical shell, an insulator arranged in the cylindrical shell, and at least one contact to be detachably inserted in a piercing aperture formed in the insulator and connected to an electric wire, the connector according to the invention comprises an earth lug incorporated in said insulator and integrally having a first contacting portion contacting said cylindrical shell and a second contacting portion positioned in said piercing aperture and contacting said contact. It is a further object of the invention to provide a waterproof connector which is easy to manufacture, disassemble, repair and do other handling and able to readily connect a contact to an earth circuit.

In order to accomplish this object, a waterproof connector according to the invention comprises a shell, a rubber insulator detachably inserted in the shell, a plurality of intermediate contacts in the rubber insulator, a plurality of solderless contacts detachably fitted with the intermediate contacts, respectively, an earth lug provided on one of said intermediate contacts and said solderless contacts and electrical contacting said shell, a front insulator detachably inserted into the shell and holding the fitting of the intermediate and solderless contacts, a rear insulator detachably inserted into the shell and engaging the solderless contacts to anchor them to the front insulator, a retainer ring detachably anchored in the shell and anchoring the rear insulator in the shell, and an O-ring detachably provided in the shell and abutting against a mating connector.

The invention will be more fully understood by referring to the following detailed specification and claims taken in connection with the appended drawings.

DESCRIPTION OF THE PREFERRED EMBODIMENTS

Figure 1A:
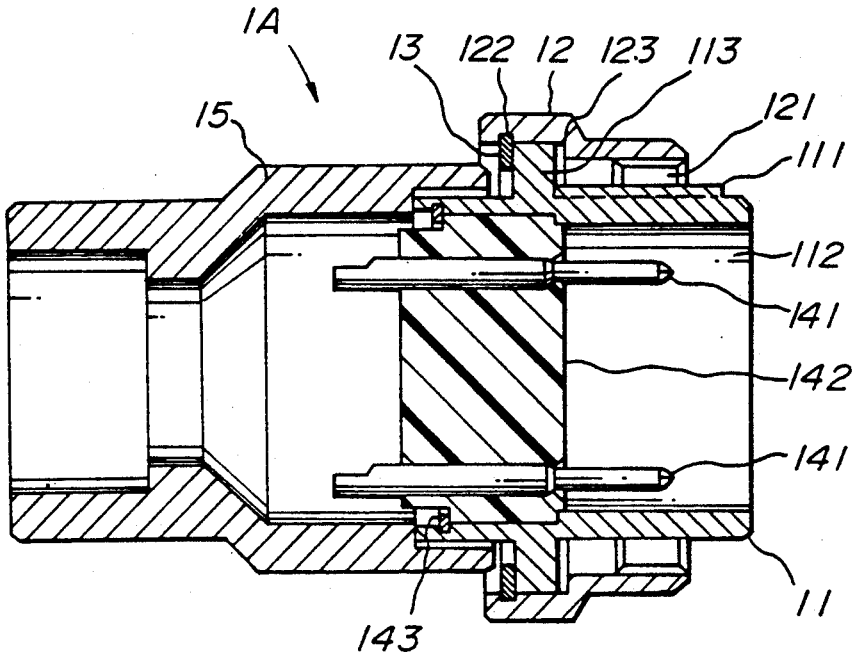
FIG 1a PRIOR ART
FIGS. 1*a* and 1*b* illustrate one example of hitherto used plug connector.
Figure 1B:
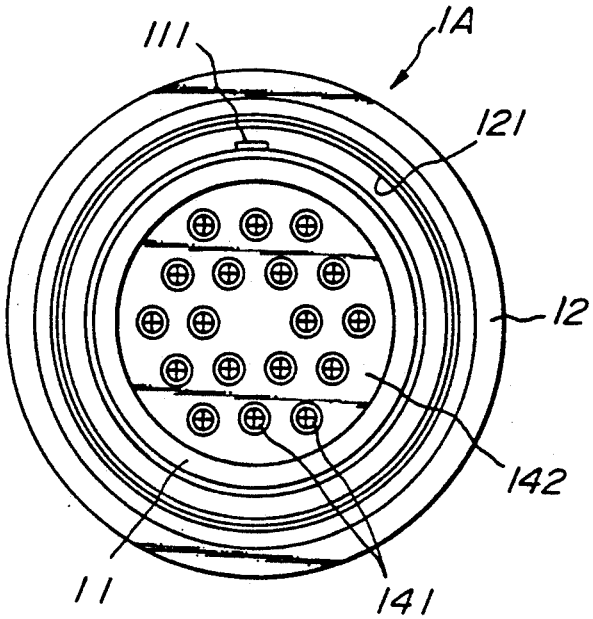
FIG 1b PRIOR ART
Figure 2:
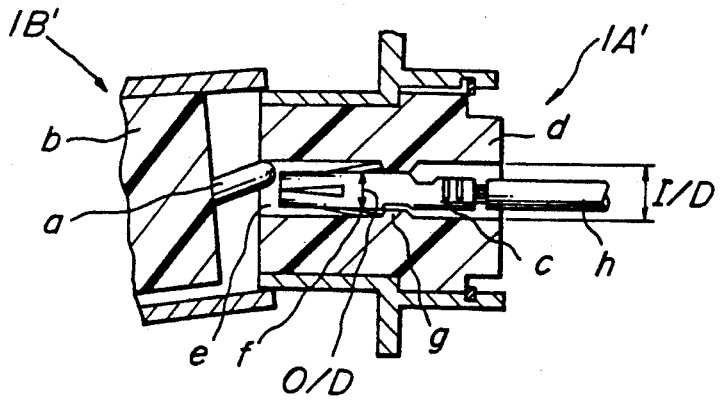
FIG 2 PRIOR ART
FIG. 2 is a sectional view illustrating another prior art connector.

FIGS. 3*a* and 3*b* and 4*a* and 4*b* illustrate one embodiment of the connector according to the invention, wherein the like components are designated by the same reference numerals as those in FIGS. 1*a* and 1*b*.

Figure 3A:
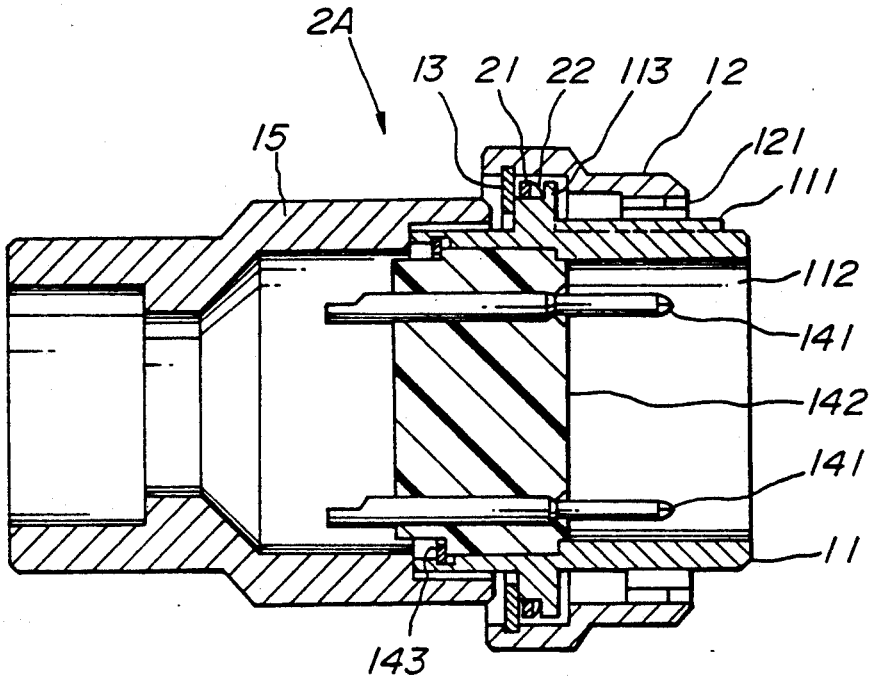
FIGS. 3*a* and 3*b* illustrate a plug connector of one embodiment of the invention.
Figure 3B:
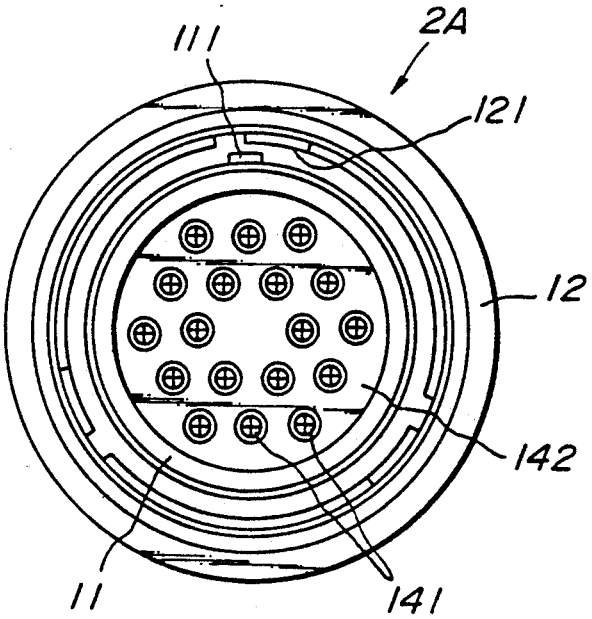
Figure 4A:
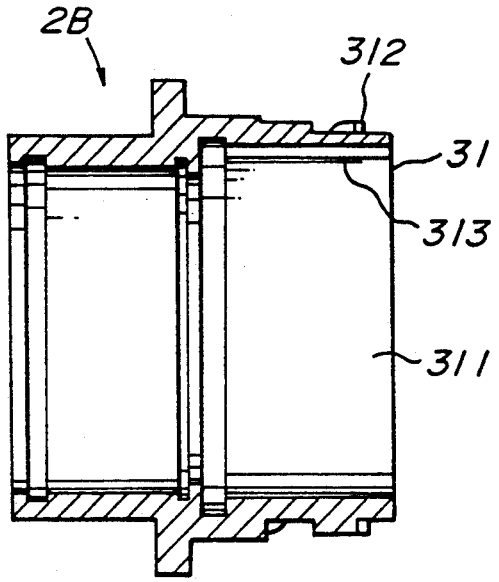
FIGS. 4*a* and 4*b* illustrate a receptacle connector to be connected to the plug connector shown in FIGS. 3*a* and 3*b;*
Figure 4B:
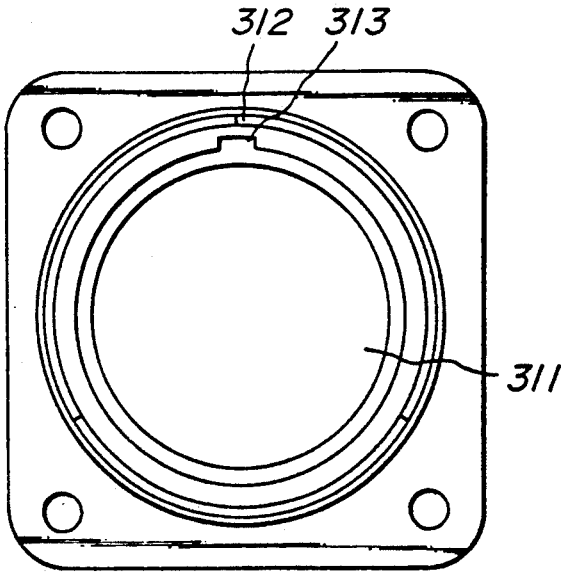

A plug connector shown in FIGS. 3*a* and 3*b* is similar to that shown in FIGS. 1*a* and 1*b* with exception that a flange 113 is formed with an annular notch 22 in which a wave-shaped annular spring 21 is arranged.

Figure 5A:
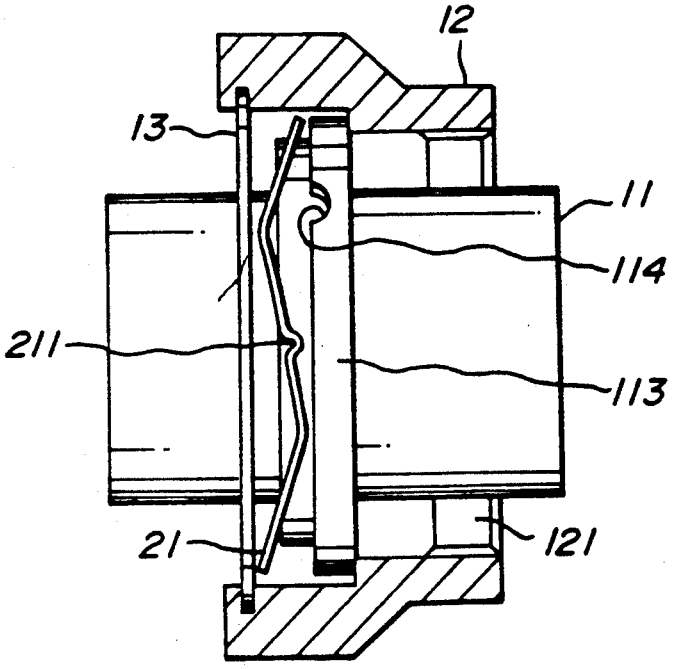
FIGS. 5*a* and 5*b* are views illustrating the operation of the connector of the one embodiment of the invention.
Figure 6A:
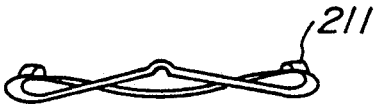
FIGS. 6*a* and 6*b* and 7 illustrate parts used in the embodiment shown in FIGS. 3*a* and 3*b* and 4*a* and 4*b;*
Figure 6B:
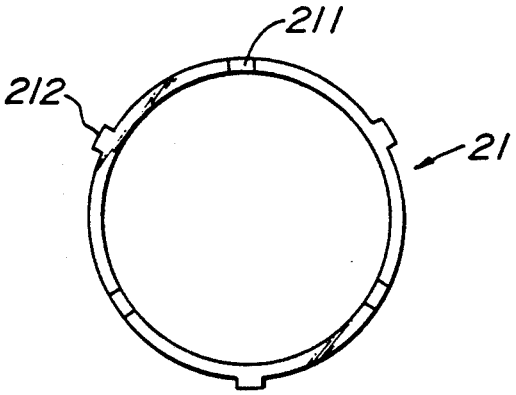

In this embodiment, the plug shell has a diameter slightly smaller than 30 mm and the flange has a diameter of about 38 mm and a thickness of about 4 mm. The flange 113 is formed with the annular notch 22 in its outer circumference on the rear side (on the left side of FIG. 3*a*). The annular notch 22 has a dimension of approximately 2 mm in radial and axial directions. The wave-shaped annular spring 21 shown in FIGS. 6*a* and 6*b* is arranged in the annular notch 22. The flange 113 is further formed with recesses 114 (FIG. 5*a*) on its rear end surface, whose purpose will be explained later.

The wave-shaped annular spring 21 is made of a stainless steel having a diameter of about 36 mm and a thickness of about 0.5 mm. The annular spring 21 is deformed to form three wave portions spaced 120° from each other along its circumference. The difference in height between tops and bottoms of the wave portions is about 4 mm. Each of the tops of the wave portions is formed with a protrusion 211 which is a semicircular protrusion having a radius of about 3 mm. Instead of the protrusions 211, recesses may be formed in the wave-shaped annular spring 21, while protrusions may be formed in the flange 113 instead of the recesses 114.

The annular spring 21 is further formed at the bottoms of the wave portions with three pawls 212 projecting from the outer circumference of the annular spring 21 for rotating together with the coupling ring 12. Each of the pawls 212 has a width of about 3 mm and a height of about 1.5 mm. The coupling ring 12 is formed in its inner circumference with three longitudinal grooves circumferentially 120° spaced from each other and mating in size with pawls 212 for permitting the wave-shaped annular spring 21 to be inserted into the coupling ring 12.

Figure 7:
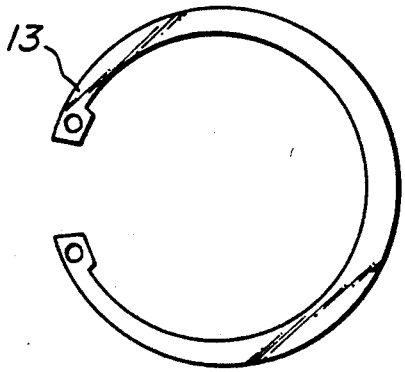

A retainer ring 13 serves as a flange urging portion and is made of a C-shaped stainless steel having a diameter of about 40 mm, a width of about 2 mm and a thickness of about 1 mm. FIG. 7 illustrates the shape of the retainer ring 13.

Fitting means 121 is a multiple (three) thread screw and has a pitch of 6 mm which enables the connectors to fit with each other to the fullest extent only by a rotation of 120°. With unified threads (single threads) hitherto used in many cases, as much as three rotations (1080°) are needed to obtain an advanced distance of 6 mm of one connector relative to the mating connector.

In this embodiment, when the coupling ring 12 is advanced, the wave-shaped annular spring 21 accommodated in the annular notch 22 of the flange is compressed between the retainer ring 13 and the radially outwardly extending wall of the annular notch 22. In this case, the difference of about 4 mm in height between the tops and bottoms of the wave portions of the wave-shaped annular spring is larger than the axially notched distance of about 2 mm of the annular notch 22 so that the retainer ring 13 first abuts against the wave-shaped annular spring 21. However, when the coupling ring is further advanced, at a certain instant the retainer ring 13 abuts against the flange 113 so that the advancing force of the coupling ring 12 is directly transmitted to the flange 113 without any action of the wave-shaped annular spring 21. This is the significant effect of this embodiment and makes easy the design of connectors without any risk of the wave-shaped annular spring yielding; in addition it exhibits stable click lock performance.

When the coupling ring 12 has been rotated about 120° from the start of fitting of the fitting means, the plug shell 11 has just been inserted into the receptacle shell 31 through approximately 6 mm which is the required fitted length. In this case, it is so constructed that the positions of the protrusions 211 of the wave-shaped annular spring 21 are coincident with the positions of the recesses 114 formed in the radially outward wall of the annular notch 22 of the flange. Therefore, the protrusions 211 detachably fall into the recesses 114, with the result that the coupling ring 12 is slightly prevented from rotating in the loosening direction and the protrusions 211 produce click sound when falling into the recesses 114.

Even with the fitting means 121 of the multiple (three) thread screw having the pitch accomplishing the 6 mm advancement only by the rotation of 120°, the coupling ring cannot be unintentionally loosened by the slight prevention of the rotation in the loosening direction.

Although the operation of the connector of this embodiment has been clear from the above explanation, it will be explained in more detail hereinafter.

In order to connect the coupling ring 12 and the receptacle shell 31, their fitting means are first fitted with each other. The fitting is then started by rotating the coupling ring 12 so that first the coupling ring 12 alone advances toward the receptacle connector 2B. As a result of this, the distance between the flange urging portion of the coupling ring 12 and the flange 113 progressively narrows so that at a certain instant the wave-shaped annular spring 21 interposed therebetween is started to be compressed. In this case, the wave-shaped annular spring 21 is formed with protrusions 211 (they may be recesses as an alternative) in opposition to the rear end surface of the flange, while the wave-shaped annular spring 21 is rotated together with the coupling ring 12. Therefore, the protrusions (or recesses) abut against the end surface of the flange 113 and slidingly move thereon.

Figure 5B:
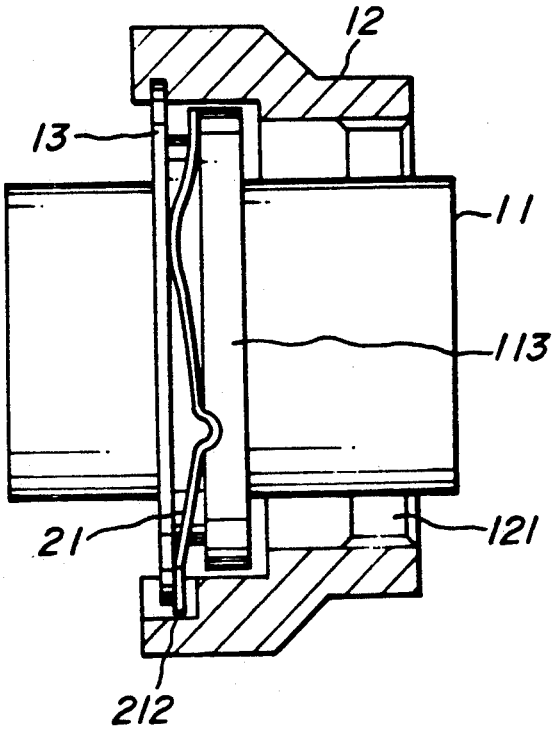

The coupling ring 12 is further rotated so that the wave-shaped annular spring 21 is further compressed, with the result that the thrust of the coupling ring 12 is directly transmitted to the flange 113. The plug shell 11 is inserted into the receptacle shell 31 in this manner, and at the same time electric contacts held and fixed to inner bores of the shells 11 and 31, respectively, are brought into contact with each other. FIG. 5*a* schematically illustrates a state of the wave-shaped annular spring 21 before fitting, and FIG. 5*b* illustrates a state of the spring 21, while the fitting progresses.

Moreover, when the fitting of the connector has been completed, the protrusions (or recesses) 211 of the wave-shaped annular spring 21 and the recesses (or protrusions) 114 of the flange 113 are coincident in positions with each other, so that these protrusions and recesses are fitted with each other producing the click sound.

In this case, these protrusions and recesses are detachably fitted with each other, and any of the protrusions and recesses are moved together with the coupling ring 12. As a result, the coupling ring 12 is slightly prevented from rotating in the loosening direction at the complete position of fitting.

On the other hand, the coupling ring 12 in the plug connector 2A before fitting with the receptacle connector 2B is held by the flange 113 with certain play or clearance but rotatable relative to the flange 113.

With this embodiment, as provision is made of the click lock means in which the protrusions fall into the recesses upon completion of the fitting, the following particular effects can be brought about according to the invention.

(1) The coupling ring 12 is prevented slightly from rotating in the loosening direction. For example, even if screw threads of large pitch are used for the fitting means 121 and 312, there is no longer any risk of the coupling ring being loosened due to vibrations or the like. Pitches of the screw threads of the fitting means can be freely selected so as to obtain torque of a required value to be applied to the coupling ring 12.

(2) An operator can detect the completion of connection of the connectors by the click sound and vibration occurring when the protrusions fall into the recesses with the aid of hand feeling, with consequent less chance of incomplete fitting and overtightening of the fitting means.

(3) The click lock means does not detrimentally affect the rotatability of the coupling ring 12 before fitting, maintaining the effect that the fitting can be started relying upon hand feeling when manually rotating the coupling ring 12.

Figure 8:
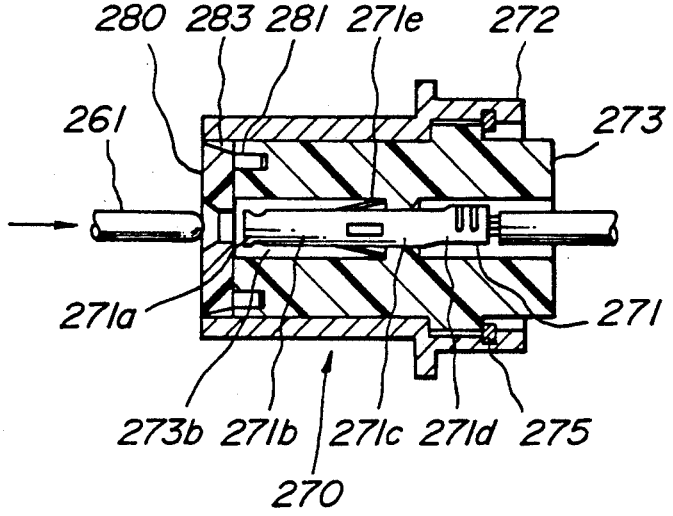
FIG. 8 is a sectional view illustrating a front release connector of the second embodiment of the invention.
Figure 9:
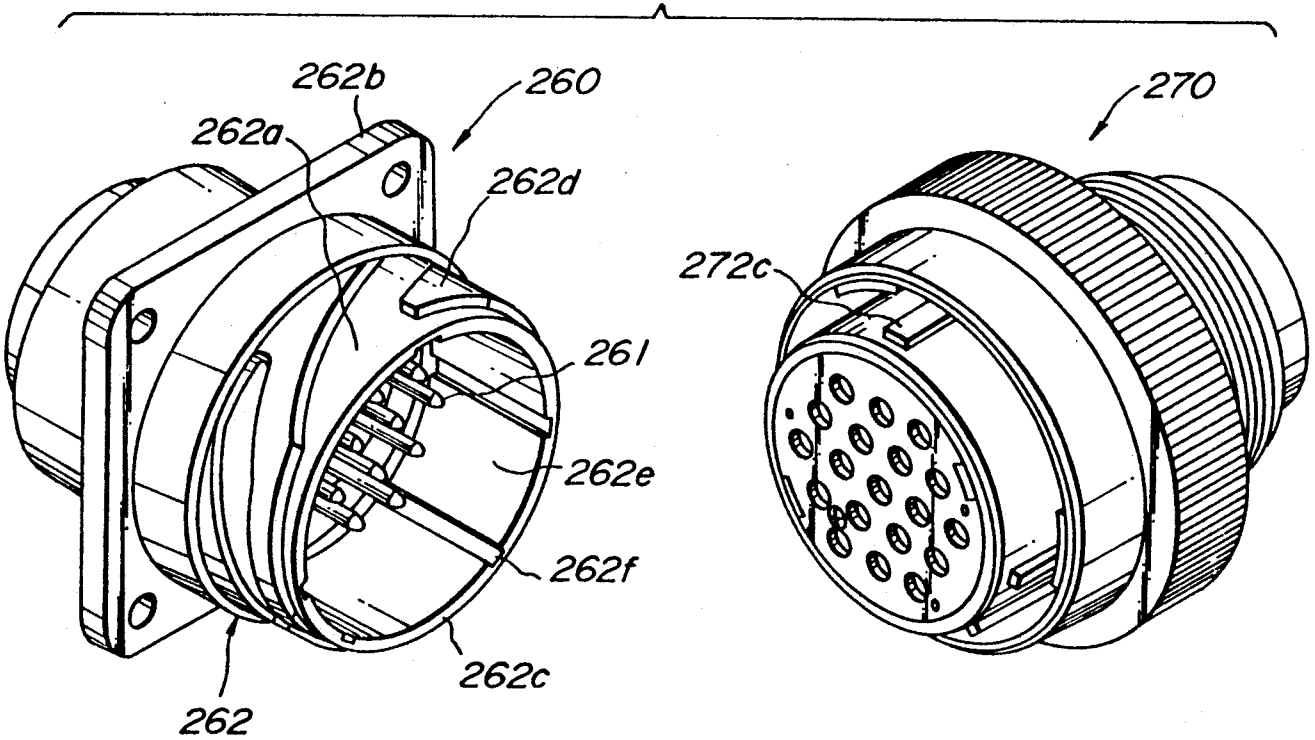
FIG. 9 is an exploded perspective view of the plug connector and the receptacle connector of the front release connector shown in FIG. 8.
Figure 10:
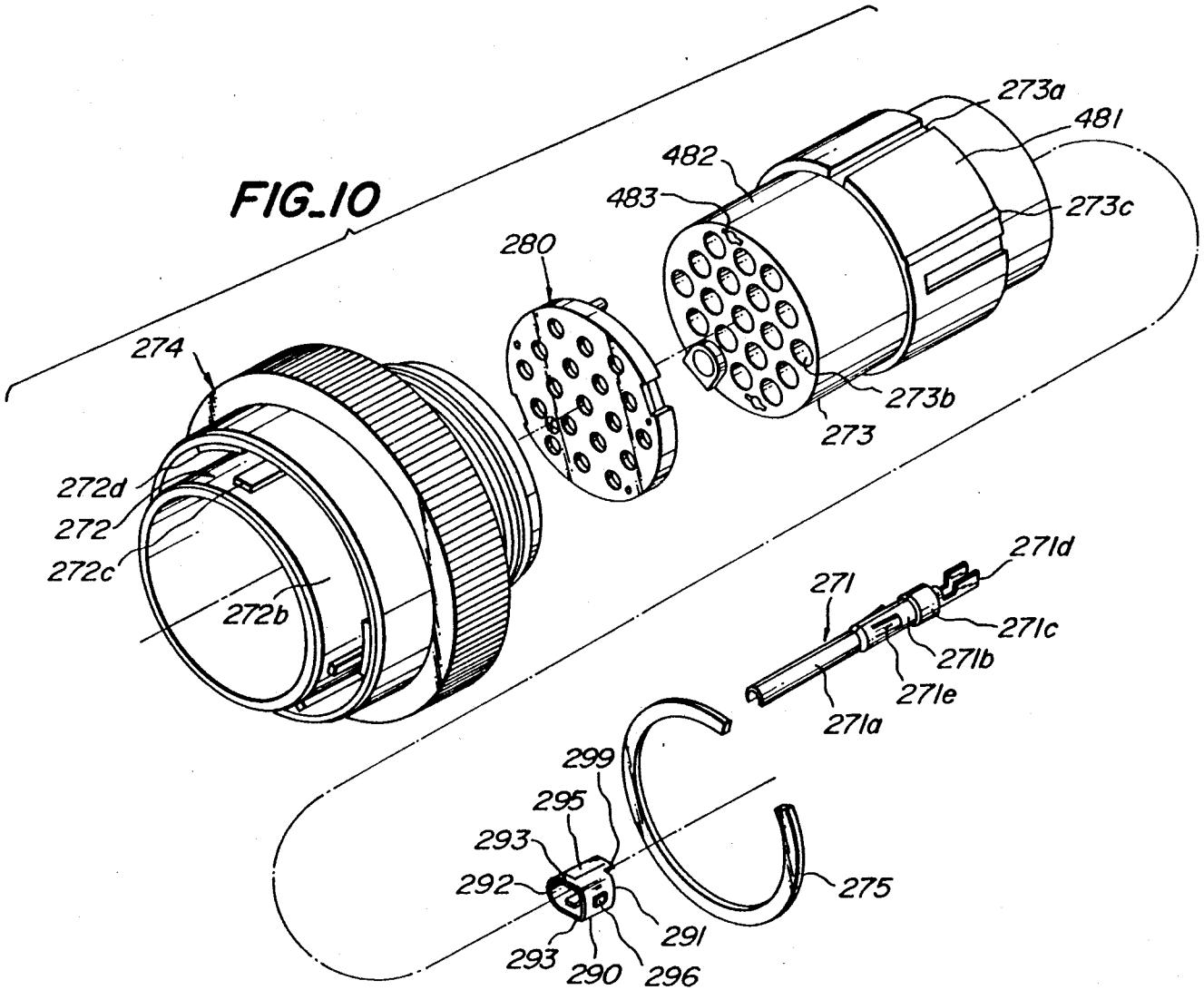
FIG. 10 is an exploded perspective view illustrating the plug connector shown in FIG. 9.

FIG. 8 illustrates another embodiment of the invention as a front release connector. FIG. 9 illustrates a plug connector together with a receptacle connector of the front release connector shown in FIG. 8. The receptacle connector 260 has a plurality of conductive pin contacts 261, while the plug connector 270 has a plurality of conductive pin contact 271.

Figure 11A:
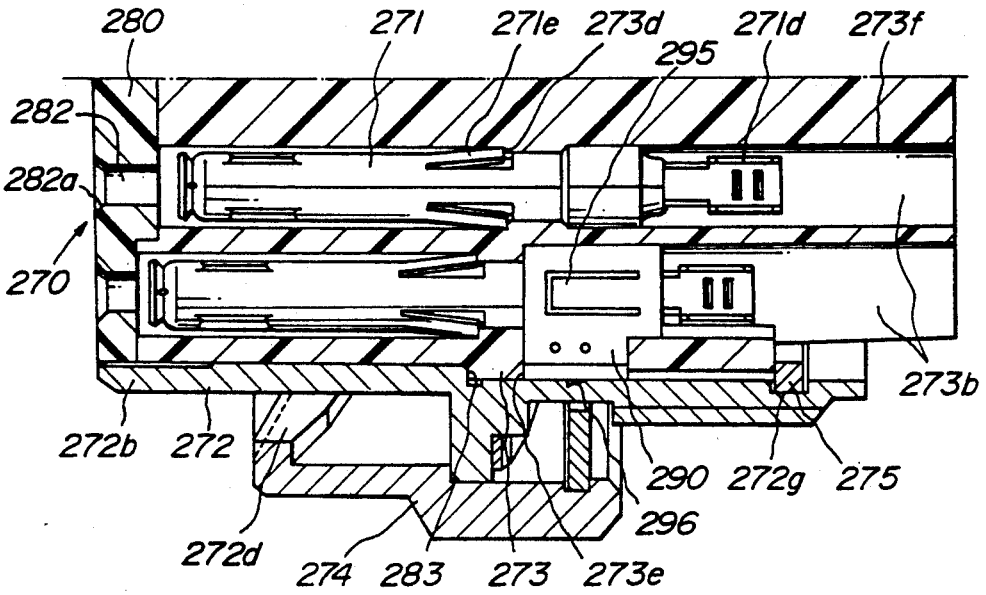
FIG. 11*a* is a longitudinal sectional view of the plug connector shown in FIG. 10.
Figure 11B:
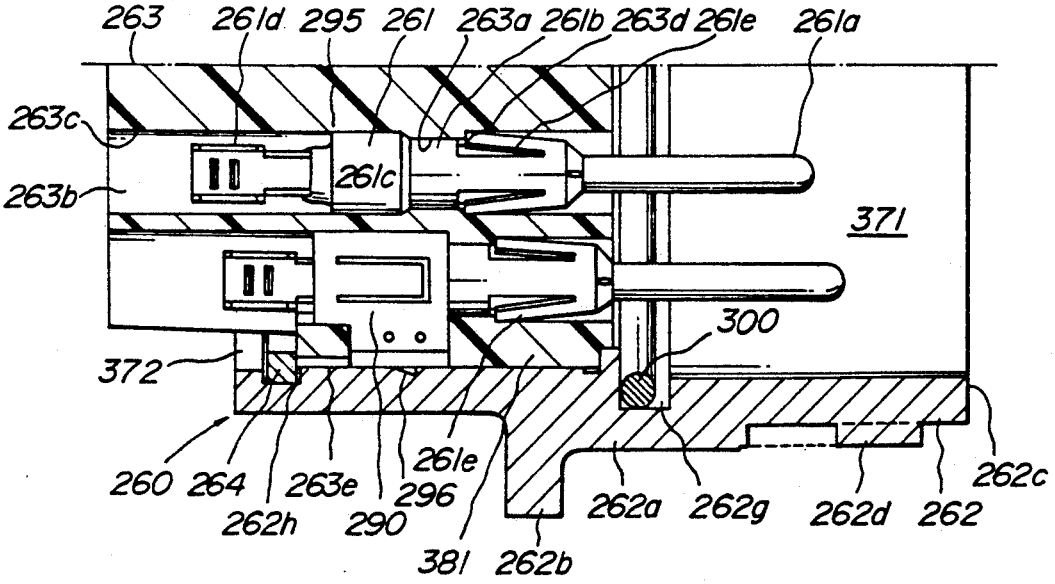
FIG. 11*b* is a longitudinal sectional view of the receptacle connector shown in FIG. 9.
Figure 12A:
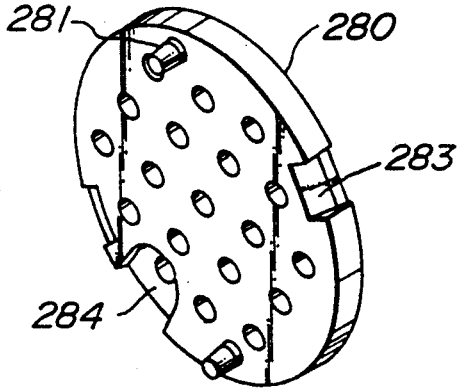
FIGS. 12*a*, 12*b*, 12*c* and 12*d* are perspective, front, side and rear views of a cover insulator used in the connector shown in FIG. 8.
Figures 12B, 12C, 12D:
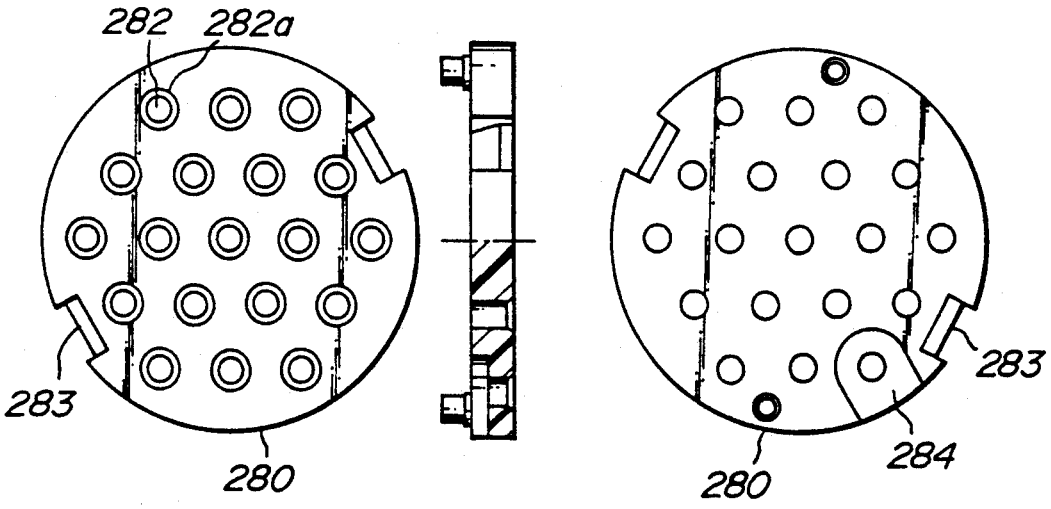

As shown in FIGS. 9 and 11*b*, the receptacle connector 260 includes, other than the pin contacts 261, a cylindrical conductive receptacle shell 262, an insulator 263 fitted in the receptacle shell 262 and holding the pin contacts 261, and a retaining ring 264 fitted in the receptacle shell 262 to anchor the insulator 263 in the shell 262. One of the plurality of pin contacts 261 is provided with a conductive earth lug 290.

Each of the pin contacts 261 may be well-known and includes a cylindrical portion 261*b* formed at its end with a pin 261*a*, a large diameter cylinder 261*c* continuous with the cylindrical portion 261*b*, and an electric wire grasping portion 261*d* formed at the rear end of the large diameter cylinder 261*c*. The cylindrical portion 261*b* is provided on its outer circumference with holding springs 261*e* diverging radially rearwardly.

The receptacle shell 262 has a cylindrical main body 262*a* and a flange 262*b* formed at a mid portion on the outer circumference of the cylindrical main body 262*a*. The cylindrical main body 262*a* is formed on the forward end with an insert bore 371 (FIG. 11*b*) for receiving the plug connector 270 and on the rearward end with a mounting bore 372 for mounting the insulator 263. The cylindrical main body 262*a* is formed on the outer circumference outwardly of the insert bore 371 with anchoring step 262*d* in the form of a spiral for anchoring the plug connector 270. The cylindrical main body 262*a* is further formed in its inner circumference 262*e* with a plurality of axial spline grooves 262*f* circumferentially spaced from each other for fitting therein protrusions 272*c* of the plug connector 270. The cylindrical main body 262 is formed rearward of the inner circumference 262*e* of the insert bore 371 with an annular groove 262*g* in which an O-ring 300 is fitted along its circumference. On the other hand, the cylindrical main body 262 is further formed in the inner circumference of the mounting bore 372 with the fitting groove 262*h* for fitting therein the retaining ring 264.

The insulator 263 is formed with pierced apertures 263*a* for inserting the pin contacts 261 thereinto.

The earth lug 290 is cylindrical and has a flat bottom wall 291, a semicircular ceiling wall 292 and opposed side walls 293, one of the side walls 293 being formed on its edge with a projecting peace 294 projecting forwardly. These side walls 293 are formed with inward facing spring pieces 295, respectively, extending into the inner space of the earth lug 290 and opening rearward. Moreover, the bottom wall 291 is formed with an outward facing spring piece 296 extending outwardly and opening rearward. This earth lug 290 is held in the insulator 263 with the inward facing spring pieces 295 contacting an outer surface of the pin contact 261 and the outward facing spring piece 296 contacting an inner surface of the receptacle shell 262. The earth lug 290 is press-fitted into a press-fitting groove 263*a* formed in the inner circumference 263*c* of the piercing aperture 263*b* under this condition. The outward facing spring piece 296 of the earth lug 290 pierces into the chromate film on a galvanized layer of the receptacle shell 262 so that one of the pin contacts 261 becomes electrically conductive with the receptacle shell 262 through the earth lug or an earth circuit is established. The pin contacts 261 contacting the earth lug 290 contacts the plug connector 270 earlier than the other pin contacts 261 to form the earth circuit.

On the other hand, as shown in FIGS. 8, 9, 10 and 11*a* the plug connector 270 includes, other than the socket contacts 271, a cylindrical conductive plug shell 272, and a base insulator 273 held by the plug shell 272 through a retaining ring 275 and holding the socket contacts 271. A coupling ring 274 is mounted on the plug shell 272, and a cover insulator 280 is detachably secured to the forward surface of the base insulator 273.

The socket contacts 271 may be well-known contacts. Each of the socket contacts 271 is formed at the forward end with a cylindrical portion 271*b* having a cylindrical part 271*a* formed therewith, a large diameter cylindrical portion 271*c* continuous with the cylindrical portion 271*b* and an electric wire grasping portion 271*d* formed on the rearward end of the large diameter portion 271*c*. The cylindrical portion 271*b* is provided on its outer circumference with holding springs 271*e* diverging rearward. The base insulator 273 is inserted into the cylindrical main body 272*b* of the plug shell 272 and held and fixed thereto by means of the retaining ring 275.

The coupling ring 274 is provided on the inner circumference on the forward side with protrusions 272*d* adapted to engage the anchoring steps 262*d* in the form of the spiral on the receptacle connector 262. Moreover, the cylindrical main body 272*b* of the plug shell 272 is provided on the outer circumference with ridges 272*c* adapted to fit in the spline grooves 262*f* formed in the cylindrical main body 262*a* of the receptacle shell 262.

Moreover, the cylindrical main body 272*b* of the plug connector 270 is formed in the inner circumference on the rearward side with a fitting groove 272*g* in which the retaining ring 275 is fitted.

The base insulator 273 includes a large diameter portion 481 and a small diameter portion 482 and is formed with piercing apertures 273*b* extending through the large and small diameter portions 481 and 482. The socket contacts 271 are inserted into these through-apertures 273*b*.

The large diameter portion 481 is formed in its Outer circumference with grooves 273*a* and ribs 273*c* in the longitudinal directions. Moreover, the inner circumference 273*f* (FIG. 11*b*) of each of the piercing apertures 273*b* is formed with an anchoring shoulder 273*d* for anchoring the holding springs 271*e* of the socket contact 271, and with a press-fitting groove 273*e* for press-fitting the earth lug 290 thereat.

Figure 15:
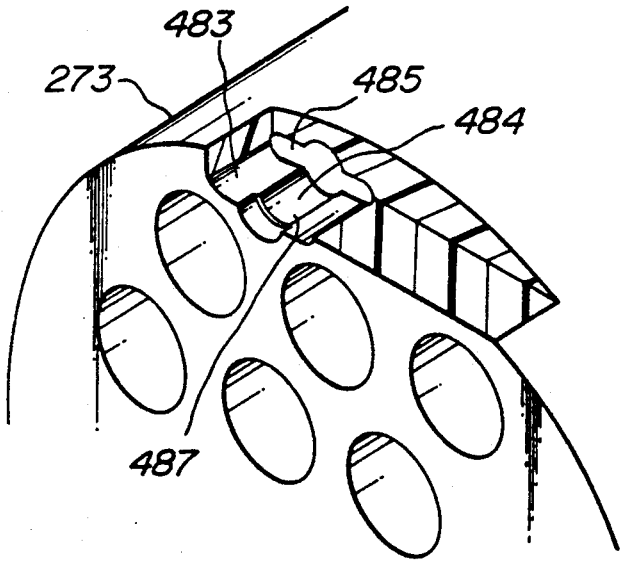
FIG. 15 is an enlarged perspective view of a principal part of the base insulator of the connector shown in FIG. 8.

The base insulator 273 is formed in its forward surface with mounting portions 483 (FIG. 15) for mounting the cover insulator 280. As shown in detail in FIGS. 15 and 16, each of the mounting portions 483 is composed of a fitting aperture 484 and grooves 485 formed on both sides of the fitting aperture 484. Moreover, the fitting aperture 484 is composed of a large diameter portion 486 formed on the opening side and a small diameter portion 487 formed on the inner side.

Figure 13:
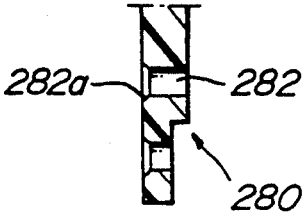
FIG. 13 is an enlarged sectional view illustrating a principal part of the cover insulator shown in FIG. 12*a;*

As shown in FIGS. 12*a*, 12*b*, 12*c* and 12*d*, the cover insulator 280 is in the form of a circular disc which is formed with a plurality of through-apertures 282 communicating with the piercing apertures 273*b* and formed on its rearward surface with mounting protrusions 281 for mounting the cover insulator 280 to the base insulator 273. The diameter of the through-apertures 282 is substantially equal to that of the cylindrical parts 271*a* of the socket contacts 271 (FIG. 11*a*) but smaller than the piercing apertures 273*b*. In other words, the through-apertures 282 have such a diameter that the pins 261*a* of the pin contacts 261 passes therethrough. Referring to FIG. 13, the cover insulator 280 is formed with introducing surfaces 282*a* opening on the side of the pin contacts.

Figure 14:
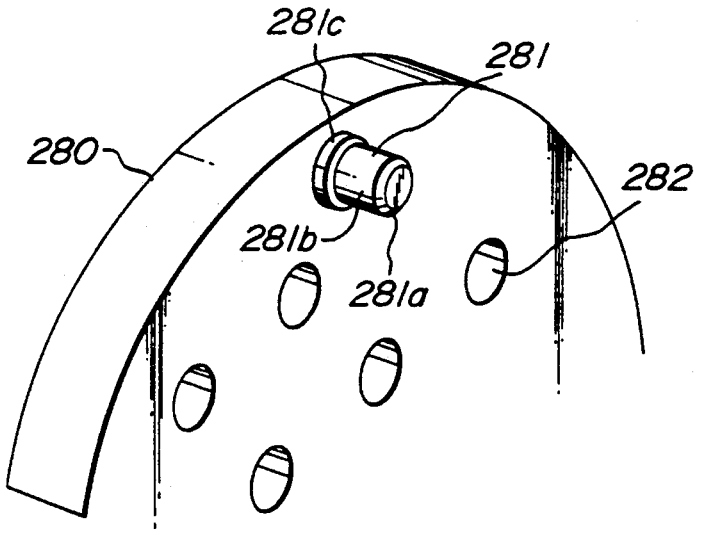
FIG. 14 is an enlarged perspective view of an important part of the cover insulator shown in FIG. 12*a;*

Moreover, as shown in FIG. 14, each of the mounting protrusions 281 is composed of a small diameter pin 281*b* formed at its end with beveling or chamfering 281*a*, and a large diameter pin 281*c* formed at the bottom of the protrusion 281. With this arrangement, the cover insulator 280 is detachably secured to the forward surface of the base insulator 273 with the aid of the mounting protrusions 281 press-fitted in the fitting apertures 484 of the base insulator 273. Reference numeral 283 in FIG. 12*a* denotes grooves for inserting a tool thereinto in order to easily remove the cover insulator 280 from the base insulator 273. Numeral 284 denotes a key for preventing misassembling of the cover and base insulators.

Figure 16:
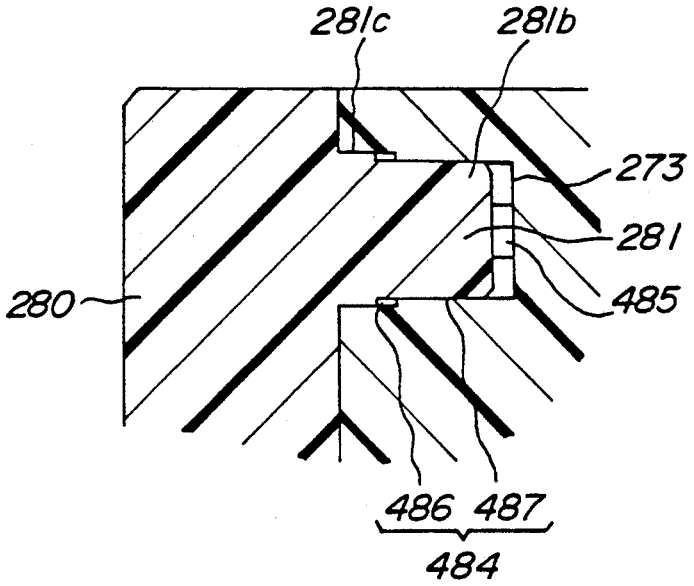
FIG. 16 is an enlarged partial sectional view illustrating a state of fitting of the cover and base insulators.
Figure 17:
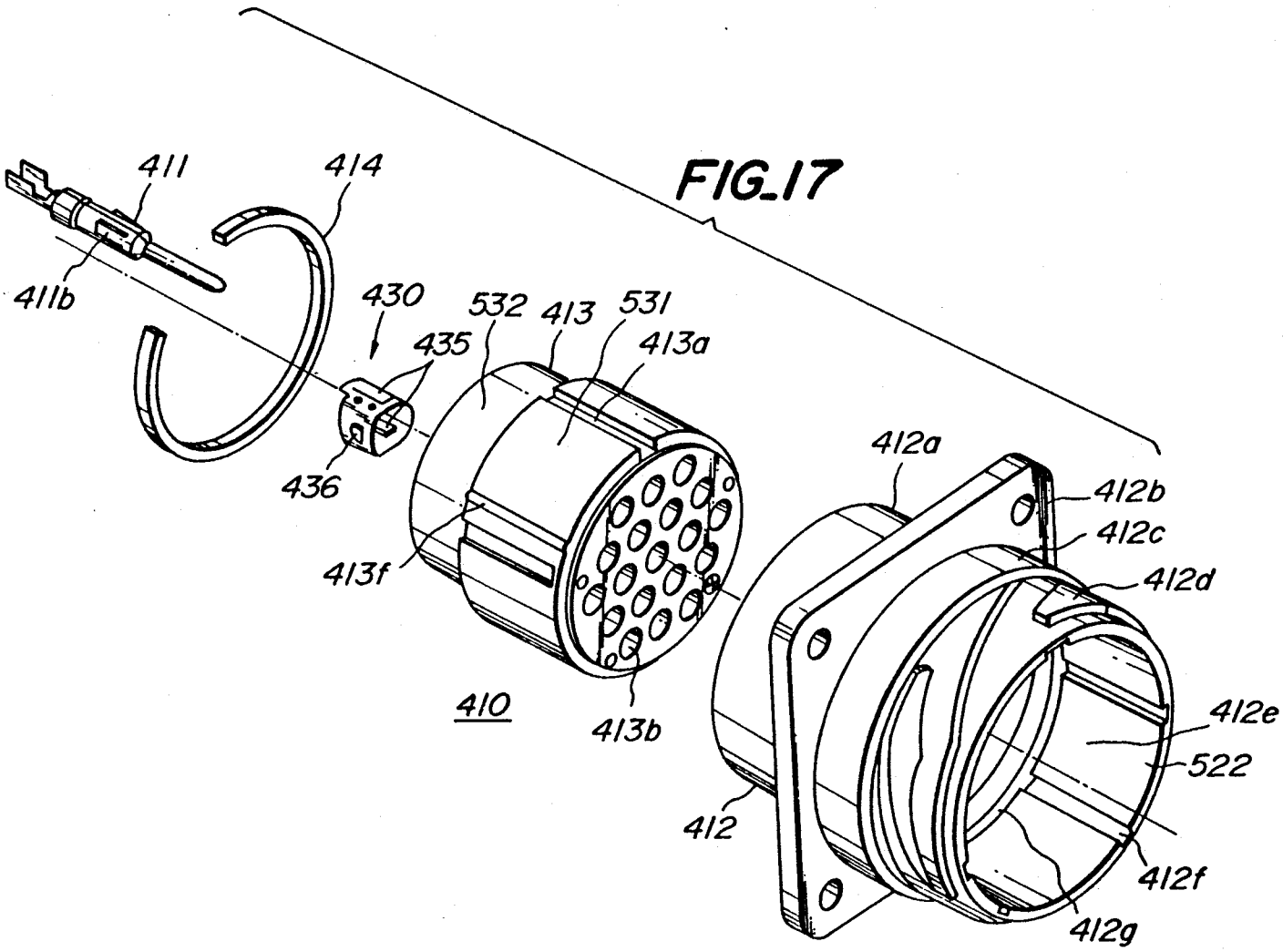
FIG. 17 is an exploded perspective view illustrating the receptacle connector of the third embodiment of the invention.
Figure 18:
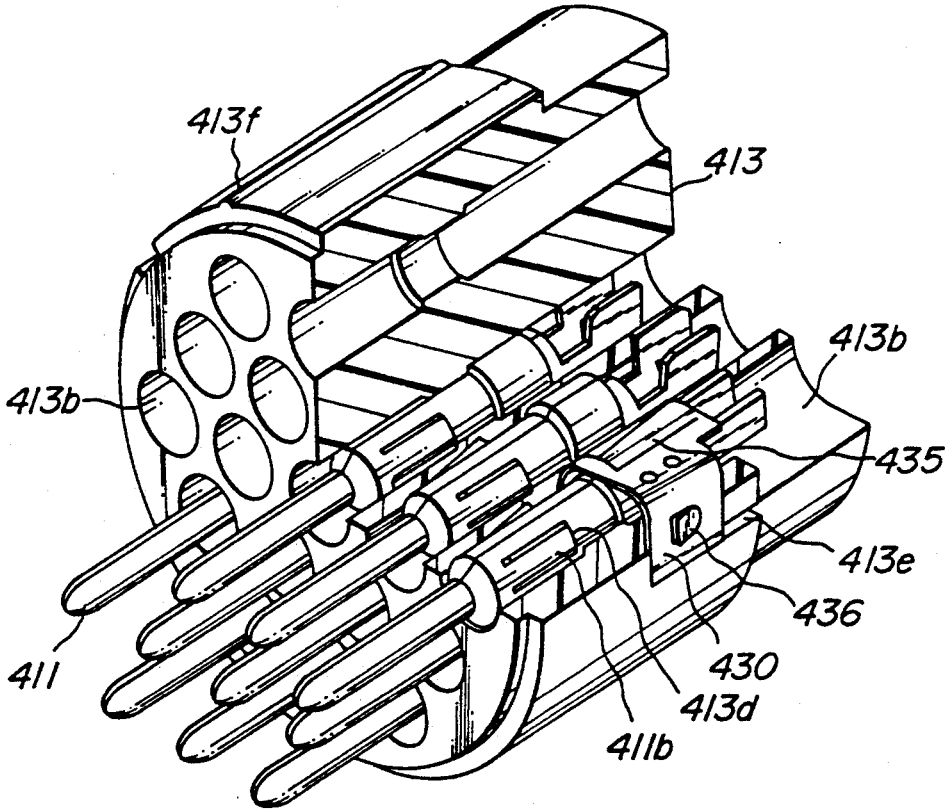
FIG. 18 is a partial sectional perspective view illustrating the assembling of the insulator, the earth lug and pin contacts.
Figure 19:
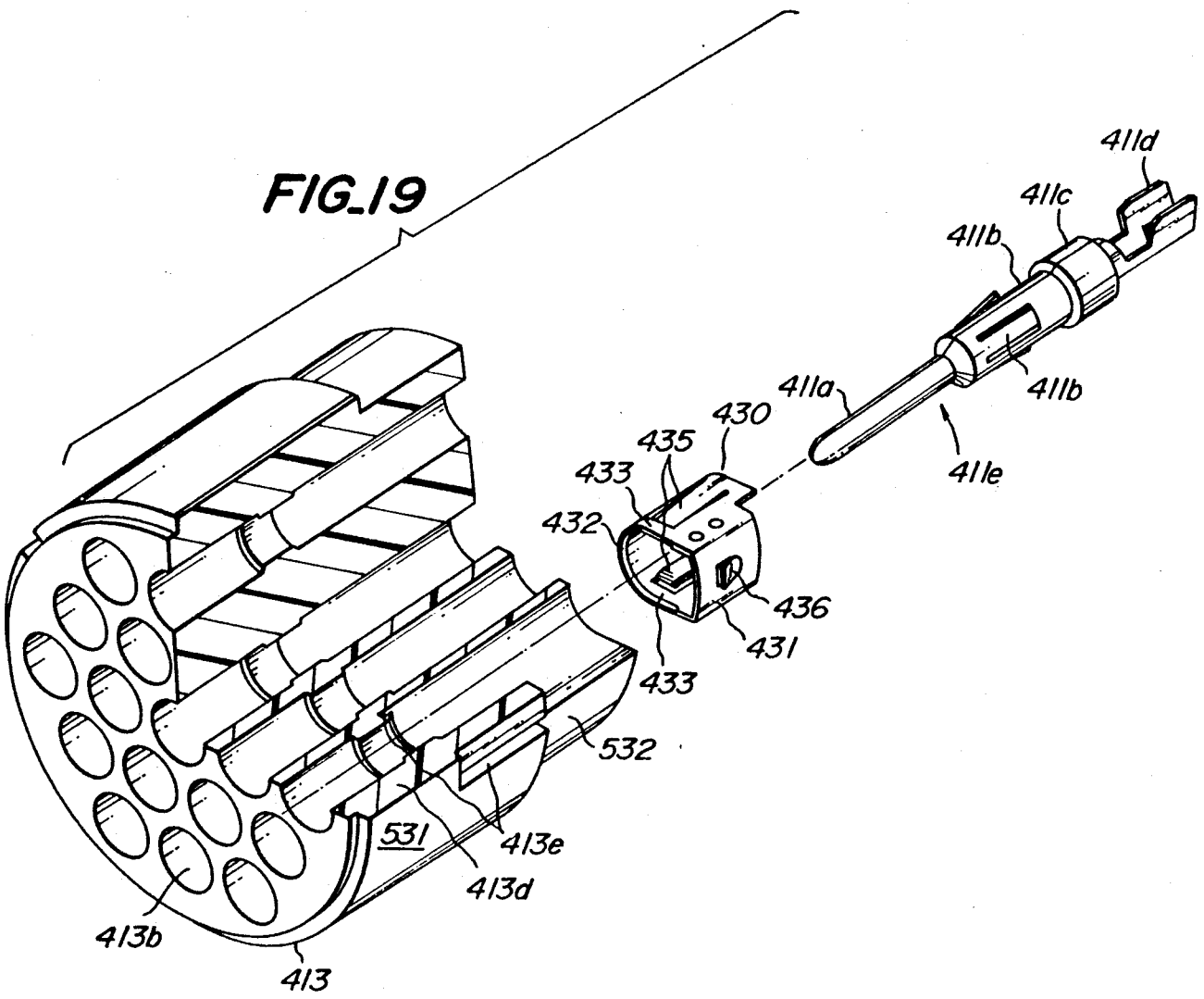
FIG. 19 is an exploded perspective view illustrating the members shown in FIG. 18.

The mounting of the cover insulator 280 onto the base insulator 273 is carried out by press-fitting the mounting protrusions 281 into the fitting apertures 484. In this case, as shown in FIG. 16, the large diameter pins 281*c* are fitted in the large diameter portions 486, while the small diameter pins 281*b* are fitted in the small diameter portions 487. Shoulders or steps between the large and small diameter portions 486 and 487 allow easy removal of the cover insulator 280 from the base insulator 273. In press-fitting the mounting protrusions 281 into the fitting apertures 484, moreover, the air escapes from the grooves 485 to make easy the press-fitting operation.

This plug connector 270 also includes an earth lug 290 in the same manner as in the receptacle connector 260 as shown in FIGS. 11*a* and 11*b*. The earth lug 290 of the plug connector 270 is held with an inward facing spring piece 295 contacting an outer surface of the socket contact 271 and an outward facing spring piece 296 contacting an inner surface of the plug shell 272. The earth lug 290 is press-fitted into a press-fitting groove 273*e* formed in the inner circumference 273*c* of the piercing aperture 273*b* under this condition. The outward facing spring piece 296 of the earth lug 290 pierces into the chromate film on a galvanized layer of the plug shell 272 so that one of the socket contacts 271 becomes electrically conductive with the plug shell 272 through the earth lug and an earth circuit is established. The socket contact 271 contacting the earth lug 290 contacts the receptacle connector 260 earlier than the other socket contacts 271 to form the earth circuit.

In this plug connector 270, the cover insulator 80 is removed from the base insulator 273, and a cylindrical removing jig (not shown) is inserted from the side of the fitting with the receptacle connector 260 into a clearance between the inner wall surface of the piercing aperture 273*b* and the socket contact 271 so that the socket contact 271 is disengaged from the anchoring to the piercing aperture 273*b*. Therefore, the socket contact 271 can be removed from the piercing aperture 273*b* by rearward pulling a cable connected to the socket contact 271. Accordingly, this plug connector 270 is called "front release connector".

When the receptacle connector 260 and the plug connector 270 are coupled each other, the pin contacts 261 are introduced into the through-apertures 282 of the cover insulator to be fitted into the socket contacts 271. At the same time, the earth circuit is formed by the earth lug 290.

As can be seen from the above explanation, with the front release connector of this embodiment, the socket and plug contacts are connected with a great certainty because the through-apertures of the cover insulator steadily guide the contacts of the mating connector to introduce their ends into positions where the ends are properly connected to the contacts of the front release connector. Moreover, by removing the cover insulator from the base insulator the removal of the contacts from the piercing apertures can be effected on the fitting side of the connector.

FIGS. 17 to 21 illustrate a further embodiment of the invention. A receptacle connector 410 includes conductive pin contacts 411, a cylindrical conductive receptacle shell 412, an insulator 413 to be fitted in the receptacle shell 412, and a retaining ring 414 for anchoring the insulator 413 in the receptacle shell 412.

The pin contacts 411 may be well-known contacts and substantially similar to those shown in FIG. 11*b*.

The receptacle shell 412 is also substantially similar to that shown in FIGS. 9 and 11*b*. The receptacle shell 412 is formed in its mounting aperture 522 with ridges (not shown) adapted to be fitted in grooves 413*a* formed in the large diameter portion 531 of the insulator 413. Moreover, the receptacle shell 412 is formed with an anchoring shoulder 413*j*.

The insulator 413 includes a large diameter portion 531 and a small diameter portion 532, these portions being formed with piercing apertures 413*b* passing therethrough for the pin contacts. The large diameter portion 531 is formed on its outer circumference with grooves 413*a* and ribs 413*f* extending in the longitudinal direction. Moreover, the piercing apertures 413*b* of the insulator 413 are formed in their inner surfaces with anchoring shoulders 413*d*, respectively, for anchoring the pin contacts 411. One of the piercing apertures 413*b* is formed with a press-fitting groove 413*e* for press-fitting therein the conductive earth lug 430.

Figure 22:
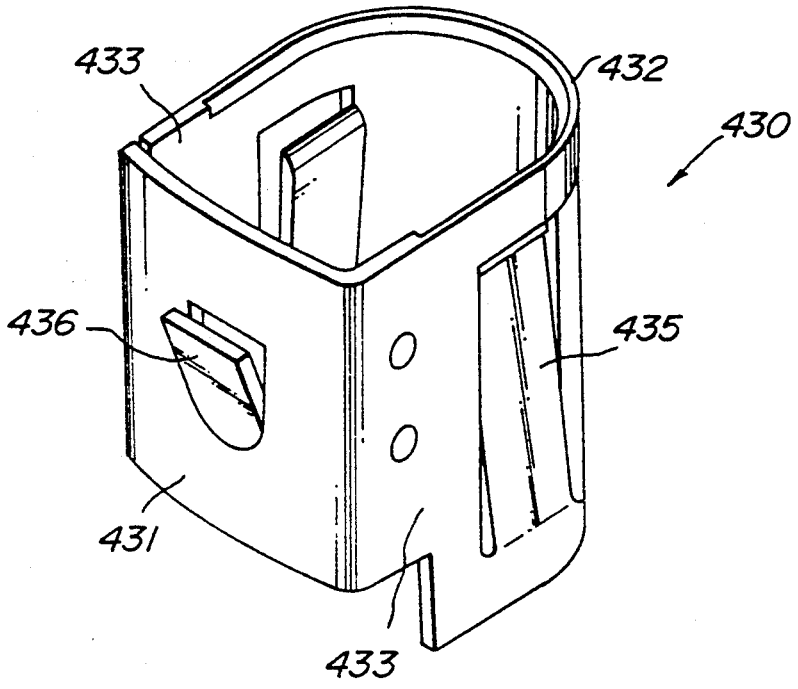
FIG. 22 is a perspective view illustrating an earth lug according to the invention.

The earth lug 430 is press-fitted in the press-fitting groove 413*e* formed in the inner circumference of the piercing aperture 413*b* to be secured to the insulator 413. As clearly shown in FIG. 22, the earth lug 430 includes a flat bottom wall 431, a semicircular ceiling wall 432 and opposed side walls 433 to form a cylindrical member. The side walls 433 are formed with inward facing spring pieces (secondary portions) 435, respectively, rearward opening and inwardly extending into the earth lug 430. The bottom wall 431 is formed with an outward facing spring piece (primary portion) 436 rearward opening and outwardly extending. When the earth lug 430 is mounted in the insulator 413, the inward facing spring pieces 435 extend inwardly of the piercing aperture 413*b* and the outward facing spring piece 436 abuts against the inner surface of the receptacle shell under pressure. At this time, the outward facing spring piece 436 of the earth lug 430 pierces into the chromate film on a galvanized layer of the receptacle shell 412 to become conductive.

Under this condition of the earth lug 430 secured to the insulator 413, the pin contact 411 is press-fitted in the piercing aperture 413*b* of the insulator 413 so that the holding springs 411*b* of the pin contact 411 engage the anchoring shoulder 413*d* formed in the inner surface of the piercing aperture 413*b* of the insulator 413. As a result, the pin contact 411 is held in the piercing aperture 413*b*.

At the same time, the inward facing spring pieces 435 abut against side surfaces of one pin contact 411 under pressure. As a result, the pin contact 411 becomes electrically conductive with the receptacle shell 412 through the earth lug 430.

Figure 20:
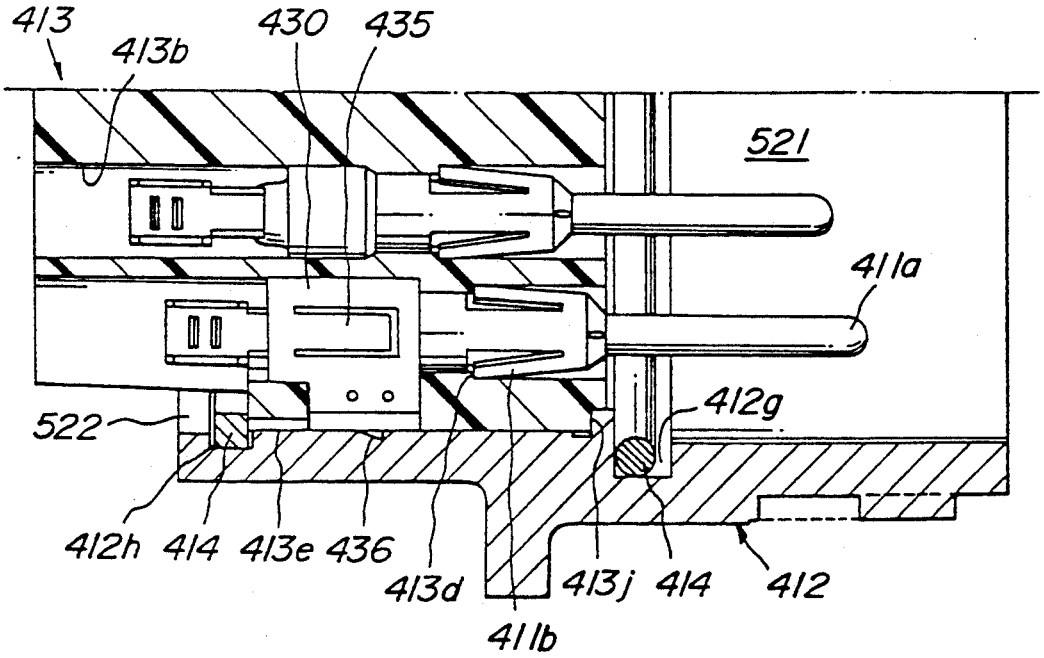
FIG. 20 is a vertical longitudinal sectional view illustrating the receptacle connector shown in FIG. 17.
Figure 21:
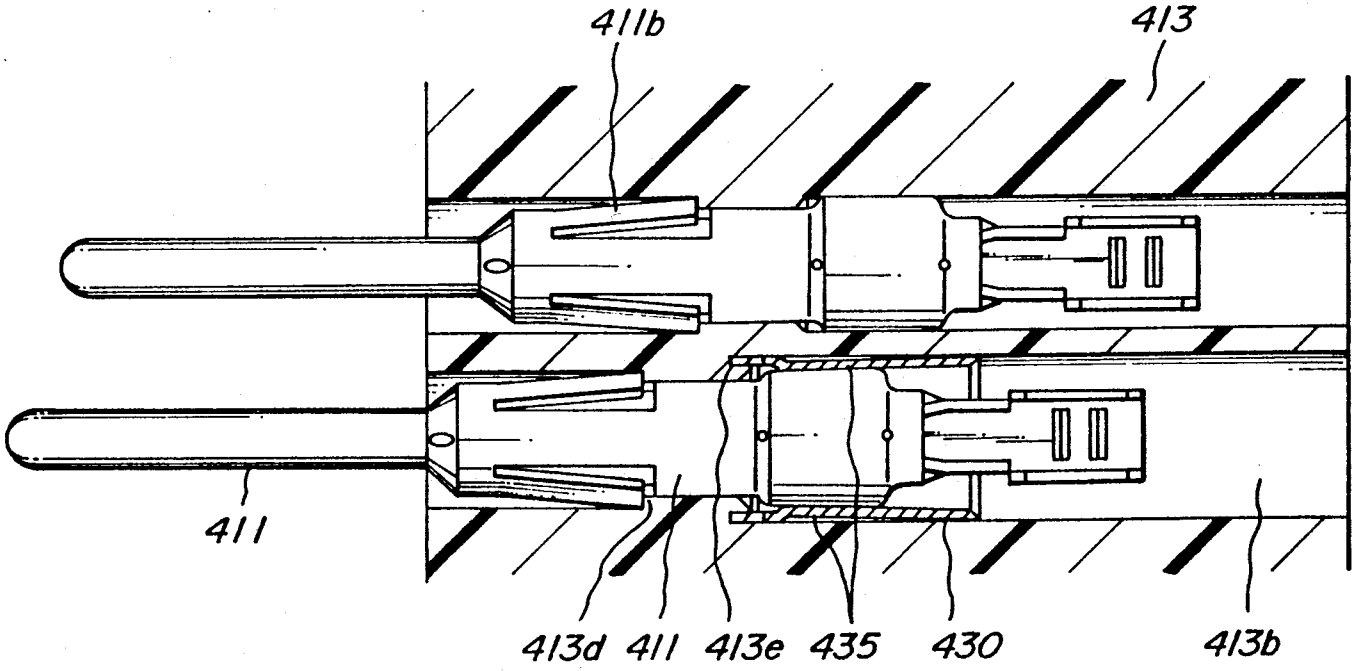
FIG. 21 is a horizontal longitudinal sectional view of the receptacle connector shown in FIG. 17.

As can be seen from FIG. 20, the pin contact 411 contacting the earth lug 430 is positioned forward of the other pin contacts so that when contacting the plug connector 420 this pin contact 411 forms an earth circuit earlier than contacting of the other pin contacts.

When the insulator 413 is press-fitted in the mounting aperture 522 of the receptacle shell 412, the forward end of the insulator 413 abuts against the anchoring shoulder 413*j* of the receptacle shell 412, and the rearward end of the insulator 413 is restrained by the retaining ring 414. The insulator 413 is press-fitted and held in the mounting aperture 522 of the cylindrical main body 412*a*.

As can be seen from the above explanation, with the connector of this embodiment, when the contact is inserted into the particular piercing aperture formed in the insulator, the contact is electrically connected to the shell through the earth lug. Therefore, an earth circuit can be readily formed without requiring any particular ground connection lead wire.

Figure 23:
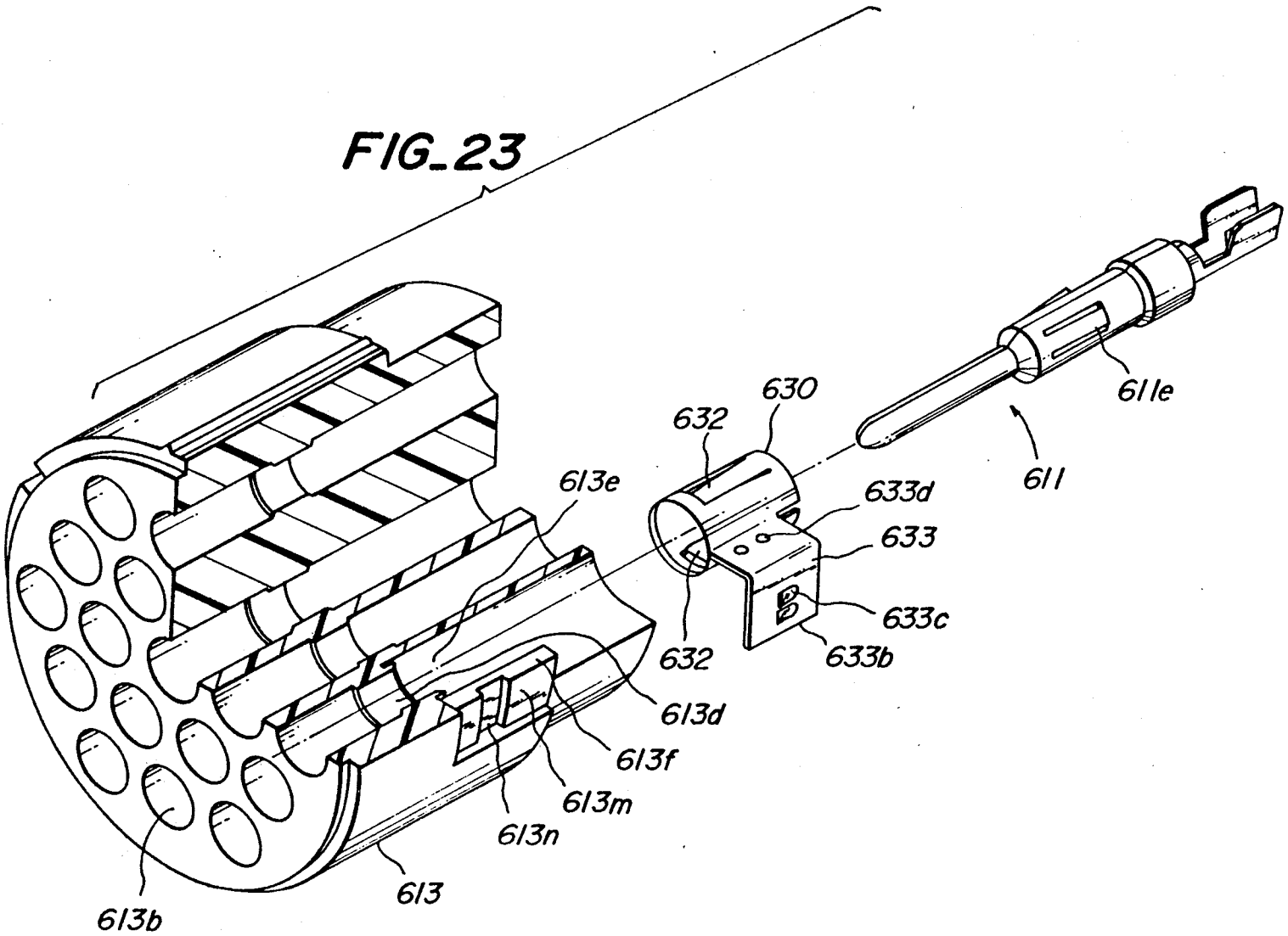
FIG. 23 is an exploded perspective view illustrating a modified embodiment of the receptacle connector of the present invention, in which mainly the earth lug is formed differently.
Figure 24A:
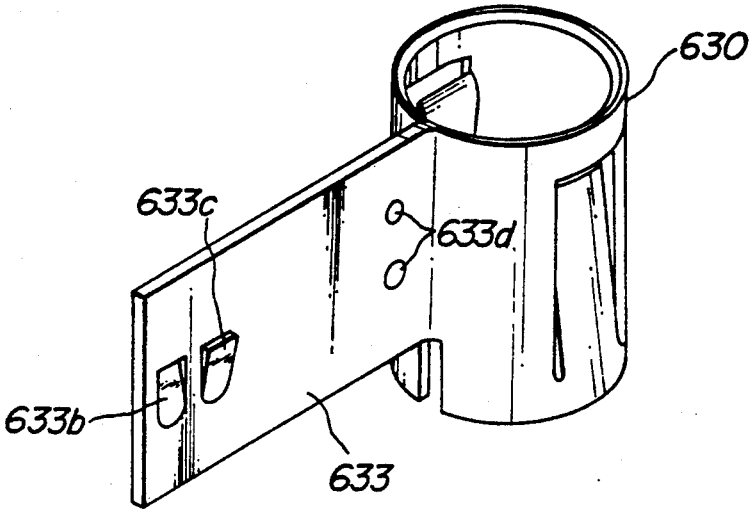
FIGS. 24*a* and 24*b* are enlarged perspective views showing the earth lug shown in FIG. 23.
Figure 24B:
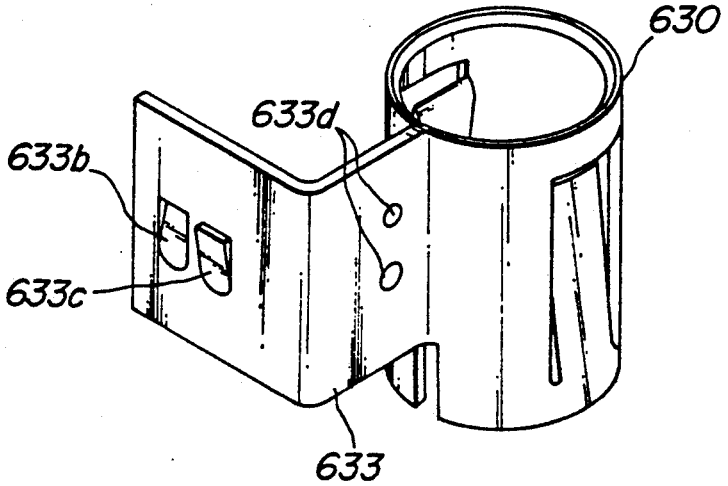

FIGS. 23 and 24*a* and 24*b* illustrate a further embodiment of the invention.

In the electrical connector having an earth lug 630, the piercing aperture 613*b* is provided with a fitting portion 613*e* in which an earth lug 630 is provided. The earth lug 630 comprises spring pieces 632 contacting a contact and belt-shaped piece 633 having a free end projecting from the outer circumferential surface of the insulator 613. The projecting free end is wound around the outer circumferential surface to contact the shell. With this arrangement, an earth circuit can be very easily formed without using particular lead wires.

In this case, the belt-shaped piece 633 is preferably formed on both sides of its free end with protrusions 633*b* and 633*c* projecting from both surfaces of the end. Moreover, the belt-shaped piece 633 is formed at its bottom with dowels 633*d* which press-fitted in a slit 613*f* formed in the insulator. The insulator includes a receiving portion 613*m* for receiving the free end of the belt-shaped piece 633 projecting from the outer circumferential surface of the insulator, and a recess 613*n* for receiving the protrusion 633*b* formed on one surface of the free end of the belt-shaped piece. The protrusion 633*c* formed on the other surface of the free end of the belt-shaped piece contacts the shell.

In a more preferable embodiment, the piercing aperture 613*b* includes a reduced diameter portion 613*d*, and the contact 611 has holding spring pieces 611*e* engaging one end opening of the reduced diameter portion 613*d*. Free ends of the spring pieces formed on the earth lug are positioned near the other end opening of the reduced diameter portion.

Figure 25:
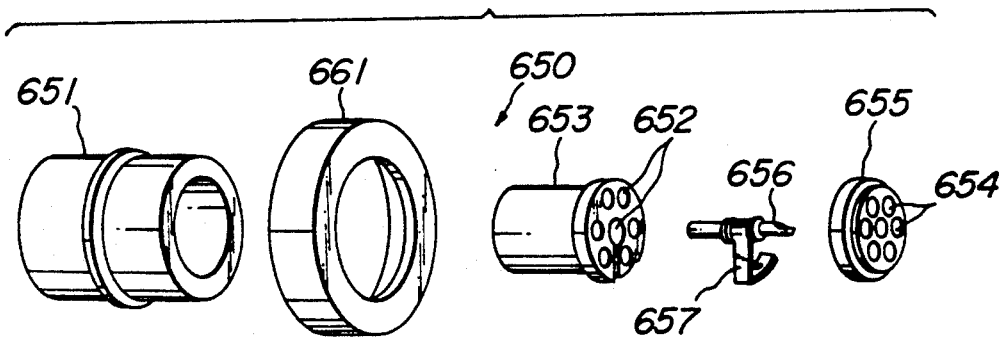
FIG. 25 is an exploded perspective view of still further modified embodiment of the receptacle connector of the present invention, in which the earth lug and the insulators are formed differently.
Figure 26:
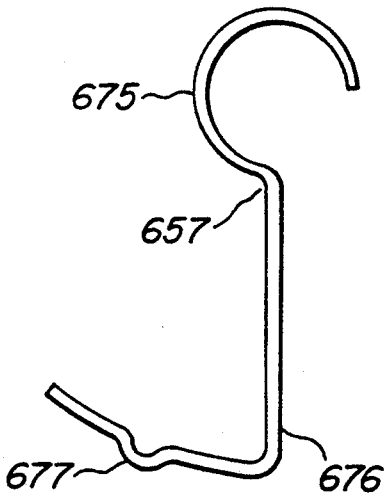
FIG. 26 shows enlarged side view of the earth lug shown in FIG. 25.

Moreover, referring to FIGS. 25 and 26 a connector 650 having an earth lug 657 is constructed in the following manner. Referring to FIG. 25 the connector includes a cylindrical conductive shell 651, an insulating front insulator 653 arranged in the cylindrical conductive shell and having first piercing apertures 652, an insulating rear insulator 655 arranged in the conductive shell and abutting against the front insulator 653 and having second piercing apertures 654, and contacts 656 having one end fitted in the first piercing aperture 652 and the other end fitted in the second piercing aperture 654. The earth lug 657 is arranged in at least one of the first and second piercing apertures 652 and 654. The earth lug 657 includes a spring piece 675 for elastically holding a contact 656 and a belt-shaped piece 676 extending from the spring piece and having a free end which projects from an outer circumferential surface of at least one insulator of the front and rear insulators 653 and 655 and is wound therearound to contact the shell. Reference numeral 661 denotes a coupling ring.

The earth lug is press-fitted in the fitting portion of the piercing aperture formed in the insulator. The insulator includes a large diameter portion formed with ribs at equal distances from the protrusion 633*c* of the earth lug 630 when the belt-shaped piece is wound around the outer circumferential surface of the insulator. With this arrangement having the ribs, the insulator is effectively held relative to the receptacle shell concentric thereto in a very stable condition, when the insulator is fitted into the receptacle shell. By means of dowels formed in the bottom of belt-shaped piece to be press-fitted in the insulator, the earth lug is effectively held by the insulator.

Figure 27:
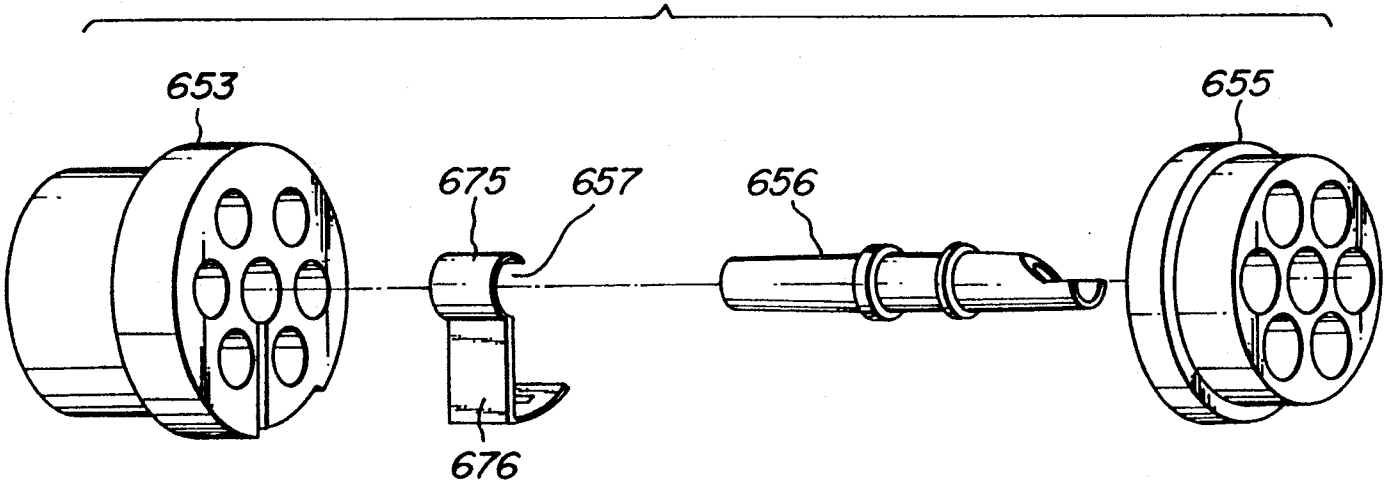
FIG. 27 shows exploded perspective view of slightly modified embodiment of the portion shown in FIG. 25.

Referring to FIG. 27, an earth lug 657 is provided with a spring piece 675 and a belt-shaped piece 676. The spring piece 675 is substantially cylindrical whose diameter is smaller than an outer diameter of a socket contact 656, and the belt-shaped piece 676 is formed at its free end with a protrusion.

Figure 28:
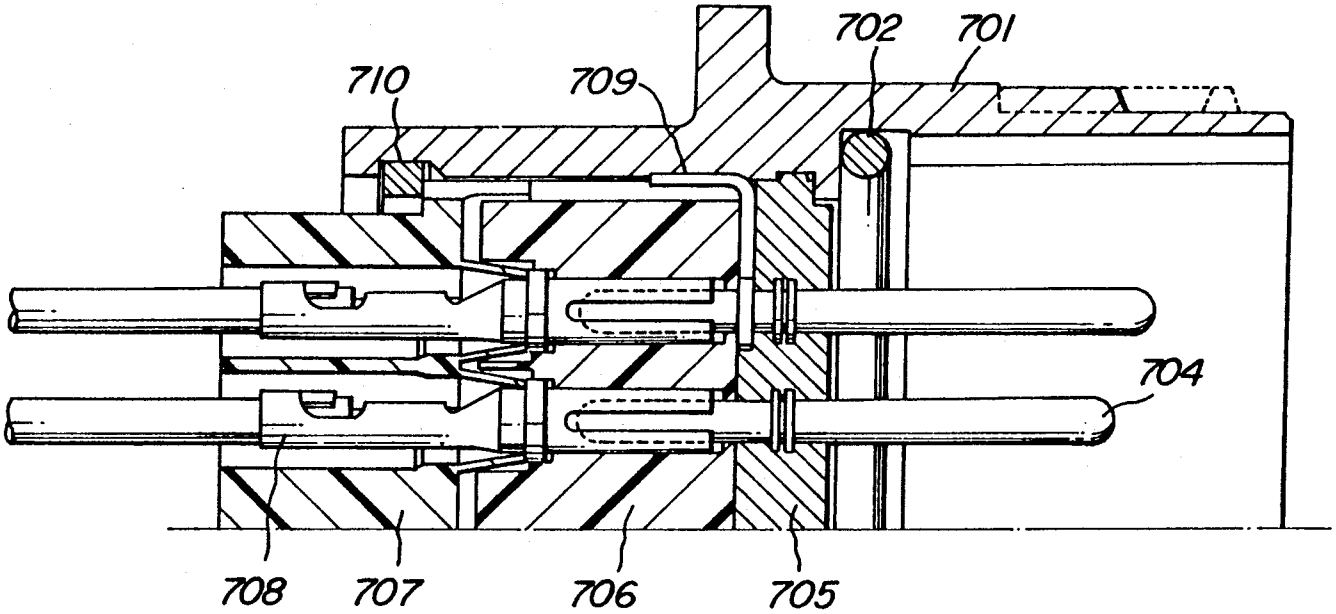
FIG. 28 is a longitudinal sectional view of a plug connector of different embodiment of the present invention.
Figure 29:
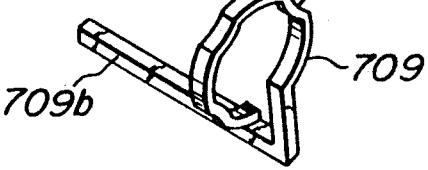
FIG. 29 is an enlarged view of an earth lug used in the connector shown in FIG. 28.

The invention may be applicable to a waterproof connector (FIGS. 28 and 29). In this case, a waterproof connector according to the invention comprises a shell 701, a rubber insulator 705 detachably inserted in the shell 701, a plurality of intermediate contacts 704 in the rubber insulator 705, a plurality of solderless contacts 708 detachably fitted with the intermediate contacts 704, respectively, an earth lug 709 provided in one of said intermediate contacts and the solderless contacts and electrically contacting the shell, a front insulator 706 detachably inserted into the shell and holding fitting of the intermediate and solderless contacts, a rear insulator 707 detachably inserted into the shell and engaging the solderless contacts to anchor them to the front insulator, a retainer ring 710 detachably anchored in the shell and anchoring the rear insulator in the shell, and an O-ring 702 detachably provided in the shell and abutting against a mating connector.

An intermediate contact 704' provided with the earth lug is longer than the other intermediate contacts 704. In the waterproof connector, the earth lug 709 is made of a thin wire having a quadrilateral section whose one end is bent into a C-shape to form a spring piece 709*a* and the other end is a belt-shaped piece 709*b* to contact said shell. With this waterproof connector using the solderless contacts, operations for production thereof is greatly improved. Therefore, this waterproof connector is superior in mass-production and inexpensive to manufacture.

Figure 30:
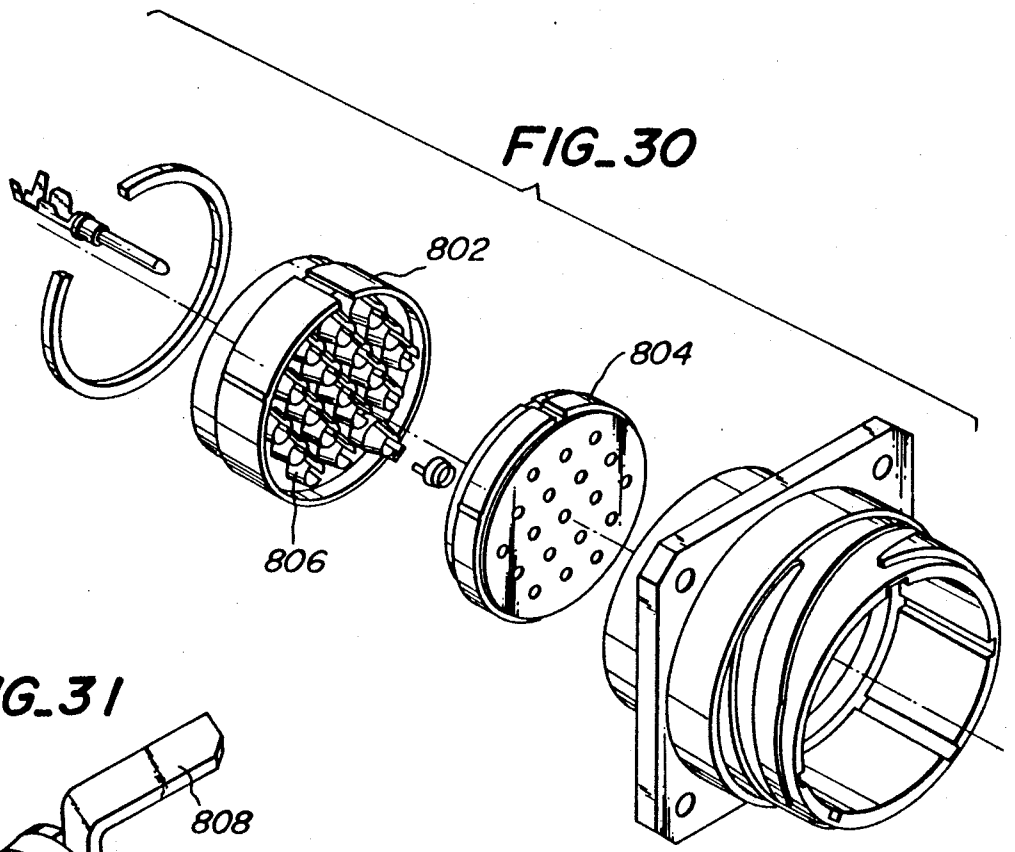
FIG. 30 is an exploded perspective view of the receptacle connector of still further embodiment of the present invention, in which the insulator is divided into two portions.

Referring to FIG. 30, an insulator is composed of a rear insulator 802 and a front insulator 804. The rear insulator has conical leafs 806 provided in a piercing aperture for holding the contact. The fitting portion is provided in the rear insulator 802. The belt-shaped piece 808 of an earth lug 810 is sufficiently longer than a radius of the insulator.

Figure 31:
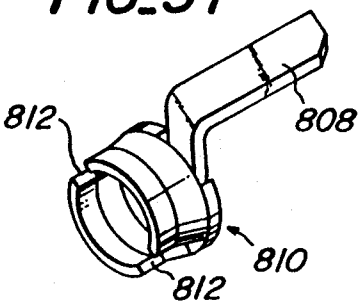
FIG. 31 is an enlarged perspective view of an earth lug used in the connector shown in FIG. 30.

As shown in FIG. 31, a spring piece of the earth lug 810 is cylindrical whose one end is reduced in diameter, and the spring piece may be formed with a plurality of slits 812 axially extending from the reduced diameter end. A clearance between the spring piece of the earth lug and the fitting portion fitted with the spring piece is substantially equal to a clearance provided at anchoring portion of a contact having no earth lug to the insulator.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An electrical connector comprising, a plug connector and a receptacle connector for receiving the plug connector fitted therewith, said receptacle connector including a cylindrical receptacle shell provided on its outer circumference with fitting means extending circumferentially about a fitting axis, said plug connector including a cylindrical plug shell having a portion to be inserted into an inner aperture of said receptacle shell and a flange provided on an outer circumference of the plug shell, a cylindrical coupling ring surrounding the outer circumference of the plug shell and rotatable and holding said flange of the plug shell on its forward and rearward sides, said coupling ring having on its inner circumference fitting means adapted to be fitted with said fitting means provided on the receptacle shell and a retainer ring located on the side of the flange opposite to said portion of the plug shell to be inserted into the receptacle shell, key means provided between the inner bore of said receptacle shell and the portion of the plug shell to be inserted into the inner aperture of said receptacle shell for preventing relative rotation between the plug and receptacle shells, at least one wave-shaped annular spring interposed between the flange and the retainer ring, said wave-shaped annular spring being rotatable together with the coupling ring, said wave-shaped annular spring and the flange being formed in their opposed surfaces with at least one protrusion and at least one recess, respectively, to form click lock means, the protrusion and the recess being oriented to be coincident in position with each other and detachably fitted with each other when said plug connector and said receptacle connector have been fitted, said plug connector and said receptacle connector being brought into coupling condition by rotation of said coupling, said electrical connector including a base insulator having at least one contact insert aperture and a contact inserted and anchored at the contact insert aperture, said contact being removable from the contact insert aperture of the base insulator by tool insertion from a connector fitting side, a cover insulator detachably secured to the base insulator on the connector fitting side and having a through-hole communication with said contact insert aperture of the base insulator and having a diameter smaller than that of the contact insert aperture, thereby enabling said through-hole to guide insertion of the contact, said cover insulator being provided with mounting protrusions for mounting the cover insulator on the base insulator, each of the mounting protrusions including a small diameter pin formed at its end with beveling and a larger diameter pin formed at the bottom of the mounting protrusion, thereby detachably securing the cover insulator to the forward surface of the base insulator by press-fitting the mounting protrusions into openings in the base insulator.

2. An electrical connector comprising, a plug connector and a receptacle connector for receiving the plug connector fitted therewith, said receptacle connector including a cylindrical receptacle shell provided on its outer circumference with fitting means extending circumferentially about a fitting axis, said plug connector including a cylindrical plug shell having a portion to be inserted into an inner aperture of said receptacle shell and a flange provided on an outer circumference of the plug shell, a cylindrical coupling ring surrounding the outer circumference of the plug shell and rotatable and holding said flange of the plug shell on its forward and rearward sides, said coupling ring having on its inner circumference fitting means adapted to be fitted with said fitting means provided on the receptacle shell and a retainer ring located on the side of the flange opposite to said portion of the plug shell to be inserted into the receptacle shell, key means provided between the inner bore of said receptacle shell and the portion of the plug shell to be inserted into the inner aperture of said receptacle shell for preventing relative rotation between the plug and receptacle shells, at least one wave-shaped annular spring interposed between the flange and the retainer ring, said wave-shaped annular spring being rotatable together with the coupling ring, said wave-shaped annular spring and the flange being formed in their opposed surfaces with at least one protrusion and at least one recess, respectively, to form click lock means, the protrusion and the recess being oriented to be coincident in position with each other and detachably fitted with each other when said plug connector and said receptacle connector have been fitted, said plug connector and said receptacle connector being brought into coupling condition by rotation of said coupling ring, said electrical connector including a base insulator having at least one contact insert aperture and a contact inserted and anchored at the contact insert aperture, said contact being removable from the contact insert aperture of the base insulator by tool insertion from a connector fitting side, a cover insulator detachably secured to the base insulator on the connector fitting side and having a through-hole communicating with said contact insert aperture of the base insulator and having a diameter smaller than that of the contact insert aperture, thereby enabling said through-hole to guide insertion of the contact, said base insulator being formed in its forward surface with mounting portions for mounting the cover insulator, each of the mounting portions including a fitting aperture and grooves formed on both sides of the fitting aperture.

* * * * *

UNITED STATES PATENT AND TRADEMARK OFFICE

CERTIFICATE OF CORRECTION

PATENT NO. : 5,181,860

DATED : January 26, 1993

INVENTOR(S) : Kazuhiro Honma, Kunio Watanabe, Takeshi Morita and Shingo Nanao

It is certified that error appears in the above-identified patent and that said Letters Patent is hereby corrected as shown below:

Column 4, line 3, delete "and" (first occurrence);

Column 5, line 25, change "aperture and contacting said contact. It is a further" to --aperture and contacting said contact.

It is a further--;

Column 10, line 28, change "contacts" to --contact--;

Column 11, line 3, change "Outer" to --outer--;

Column 12, line 12, change "80" to --280--;

Column 16, line 6, after "coupling" insert --ring--.

Signed and Sealed this

Twenty-first Day of December, 1993

*Attest:*

*Attesting Officer*

Bruce Lehman

BRUCE LEHMAN

*Commissioner of Patents and Trademarks*